US010751781B2

(12) United States Patent
Villeneuve et al.

(10) Patent No.: US 10,751,781 B2
(45) Date of Patent: Aug. 25, 2020

(54) PUNCH ASSEMBLY WITH REPLACEABLE PUNCH TIP

(71) Applicant: MATE PRECISION TOOLING, INC., Anoka, MN (US)

(72) Inventors: Larry Villeneuve, Zimmerman, MN (US); Darius Teichroew, Crystal, MN (US)

(73) Assignee: Mate Precision Tooling, Inc., Anoka, MN (US)

( * ) Notice: Subject to any disclaimer, the term of this patent is extended or adjusted under 35 U.S.C. 154(b) by 63 days.

(21) Appl. No.: 15/881,660

(22) Filed: Jan. 26, 2018

(65) Prior Publication Data

US 2018/0147617 A1 May 31, 2018

Related U.S. Application Data

(62) Division of application No. 14/985,863, filed on Dec. 31, 2015, now Pat. No. 10,646,913.

(60) Provisional application No. 62/113,778, filed on Feb. 9, 2015.

(51) Int. Cl.

| | |
|---|---|
| ***B26F 1/14*** | (2006.01) |
| ***B26D 7/26*** | (2006.01) |
| ***B21D 28/34*** | (2006.01) |
| ***B21D 37/14*** | (2006.01) |

(52) U.S. Cl.

CPC ..... *B21D 28/34* (2013.01); *B21D 37/14* (2013.01); *B26D 7/2614* (2013.01); *B26F 1/14* (2013.01)

(58) Field of Classification Search

CPC ..... B26D 2007/2607; B26D 7/2614; B26D 7/2621; B26F 1/14; B21D 28/34

USPC ..... 83/698.91, 699.21

See application file for complete search history.

(56) References Cited

U.S. PATENT DOCUMENTS

| | | | |
|---|---|---|---|
| 199,715 | A | 1/1878 | Jenkins |
| 1,179,476 | A | 4/1916 | Thomas et al. |
| 1,377,292 | A | 5/1921 | Staron |
| 1,383,414 | A | 7/1921 | Mansell |
| 1,386,259 | A | 8/1921 | Jourdan et al. |
| 1,569,136 | A | 1/1926 | Pardee, Jr. |
| 1,726,012 | A | 8/1929 | Bilz |
| 1,784,911 | A | 12/1930 | Schlitters, Jr. et al. |
| 1,806,694 | A | 5/1931 | Markson |
| 1,910,275 | A | 5/1933 | Alden |

(Continued)

FOREIGN PATENT DOCUMENTS

| | | | |
|---|---|---|---|
| BE | 1014961 | A3 | 7/2004 |
| CA | 2098235 | A1 | 12/1994 |

(Continued)

OTHER PUBLICATIONS

First Office Action for Chinese Patent Application No. 201680020757.4, dated Nov. 22, 2018 (10 pages).

(Continued)

*Primary Examiner* — Kenneth E Peterson

(74) *Attorney, Agent, or Firm* — Dorsey & Whitney LLP

(57) ABSTRACT

A punch system or assembly includes a punch body and a punch tip or insert with a working end and a stem configured for selective engagement and disengagement within a cavity in the punch body. A latch mechanism which can be operated without tools is configured to engage the punch tip stem within the axial cavity in a closed position, and to disengage the punch tip from the punch body in an open position.

20 Claims, 16 Drawing Sheets

(56) References Cited

U.S. PATENT DOCUMENTS

| | | | | |
|---|---|---|---|---|
| 1,979,059 | A | | 10/1934 | Wallman et al. |
| 2,107,581 | A | | 2/1938 | Parsons et al. |
| 2,245,676 | A | | 6/1941 | Johnson |
| 2,380,343 | A | | 7/1945 | Stellin et al. |
| 2,420,146 | A | | 5/1947 | Otto et al. |
| 2,431,566 | A | * | 11/1947 | Kopczynski ..... B21D 28/34 83/686 |
| 2,448,817 | A | | 9/1948 | McArthur |
| 2,522,440 | A | | 9/1950 | Freter |
| 2,614,781 | A | | 10/1952 | Engel |
| 2,801,859 | A | | 8/1957 | Kopczynski |
| 2,805,866 | A | | 9/1957 | Amend |
| 2,893,291 | A | | 7/1959 | Hollis |
| 2,927,432 | A | | 3/1960 | Parry |
| 2,955,831 | A | | 10/1960 | Zandberg et al. |
| 2,974,967 | A | | 3/1961 | Felmet |
| 3,137,193 | A | | 6/1964 | Whistler et al. |
| 3,190,160 | A | | 6/1965 | Armacost |
| 3,289,519 | A | | 12/1966 | Piccone |
| 3,447,455 | A | | 6/1969 | Shneider |
| 3,495,493 | A | | 2/1970 | Herb et al. |
| 3,530,750 | A | | 9/1970 | Daniels |
| 3,548,700 | A | | 12/1970 | Herzog et al. |
| 3,600,999 | A | | 8/1971 | Dennis |
| 3,640,170 | A | | 2/1972 | Bennett |
| 3,641,860 | A | | 2/1972 | Whistler et al. |
| 3,735,993 | A | | 5/1973 | Seibert |
| 3,763,730 | A | | 10/1973 | Ahlegian |
| 3,831,483 | A | | 8/1974 | Beauplat |
| 3,904,816 | A | | 9/1975 | Keller et al. |
| 4,092,888 | A | | 6/1978 | Wilson |
| 4,146,239 | A | | 3/1979 | Martin |
| 4,174,648 | A | | 11/1979 | Wallis |
| 4,273,015 | A | | 6/1981 | Johnson |
| 4,375,774 | A | | 3/1983 | Wilson et al. |
| 4,446,767 | A | | 5/1984 | Wilson |
| 4,503,741 | A | | 3/1985 | Hunter |
| 4,526,077 | A | | 7/1985 | Deguvera |
| 4,718,161 | A | | 1/1988 | Pfister et al. |
| 4,762,043 | A | | 8/1988 | Sneed |
| 4,850,755 | A | | 7/1989 | Spencer |
| 4,989,484 | A | | 2/1991 | Johnson et al. |
| 5,020,407 | A | | 6/1991 | Brinlee |
| 5,044,244 | A | | 9/1991 | Olson |
| 5,131,303 | A | | 7/1992 | Wilison et al. |
| 5,271,303 | A | | 12/1993 | Chatham |
| 5,301,580 | A | | 4/1994 | Rosene et al. |
| 5,317,894 | A | | 6/1994 | Southard |
| 5,329,835 | A | | 7/1994 | Timp et al. |
| 5,647,256 | A | | 7/1997 | Schneider |
| 5,746,104 | A | | 5/1998 | Russell et al. |
| 5,752,424 | A | | 5/1998 | Rosene et al. |
| 5,832,798 | A | | 11/1998 | Schneider et al. |
| 5,839,341 | A | | 11/1998 | Johnson et al. |
| 5,884,546 | A | | 3/1999 | Johnson |
| 5,887,502 | A | | 3/1999 | Yamaguchi et al. |
| 6,047,621 | A | | 4/2000 | Dries et al. |
| 6,082,516 | A | | 7/2000 | Willer |
| 6,142,052 | A | | 11/2000 | Endo |
| 6,196,103 | B1 | | 3/2001 | Sch et al. |
| 6,276,247 | B1 | | 8/2001 | Helda |
| 6,334,381 | B1 | | 1/2002 | Chatham |
| 6,463,839 | B2 | | 10/2002 | Ohtsuka et al. |
| 6,782,787 | B2 | | 8/2004 | Morehead et al. |
| 6,895,797 | B2 | | 5/2005 | Lowry et al. |
| 6,895,849 | B2 | | 5/2005 | Rosene et al. |
| 7,051,635 | B2 | | 5/2006 | Morehead |
| 7,069,765 | B2 | | 7/2006 | Grove et al. |
| D526,667 | S | | 8/2006 | Sakamoto et al. |
| 7,156,009 | B2 | | 1/2007 | Iwamoto et al. |
| 7,159,426 | B1 | | 1/2007 | Ghiran |
| 7,168,356 | B2 | | 1/2007 | Rosene et al. |
| 7,658,134 | B2 | | 2/2010 | Morgan et al. |
| D629,025 | S | | 12/2010 | Greenleaf et al. |
| 7,900,543 | B2 | | 3/2011 | Ikeda |
| 7,975,587 | B2 | | 7/2011 | Schneider |
| 8,327,745 | B2 | | 12/2012 | Lee et al. |
| 8,408,111 | B2 | | 4/2013 | Johnston et al. |
| D690,332 | S | | 9/2013 | Morehead et al. |
| D690,333 | S | | 9/2013 | Morehead et al. |
| D694,788 | S | | 12/2013 | Carper et al. |
| 8,707,841 | B2 | | 4/2014 | Morehead et al. |
| 8,714,065 | B2 | | 5/2014 | Takahashi et al. |
| D719,590 | S | | 12/2014 | Johnston et al. |
| D742,441 | S | | 11/2015 | Johnston et al. |
| D755,863 | S | | 5/2016 | Shimota et al. |
| D763,933 | S | | 8/2016 | Johnston et al. |
| 9,409,223 | B2 | | 8/2016 | Morehead et al. |
| D765,746 | S | | 9/2016 | Johnston et al. |
| 9,687,994 | B2 | | 6/2017 | Lee et al. |
| 9,776,337 | B2 | | 10/2017 | Lee et al. |
| 9,855,670 | B2 | | 1/2018 | Johnston et al. |
| 2003/0075034 | A1 | | 4/2003 | Brenneke |
| 2004/0011178 | A1 | | 1/2004 | Iwamoto et al. |
| 2004/0200333 | A1 | | 10/2004 | Seeley et al. |
| 2004/0206223 | A1 | | 10/2004 | Rosene et al. |
| 2006/0048623 | A1 | | 3/2006 | Schneider |
| 2006/0060046 | A1 | | 3/2006 | Sugizaki et al. |
| 2006/0081107 | A1 | | 4/2006 | Iwamoto et al. |
| 2007/0034069 | A1 | | 2/2007 | Endo et al. |
| 2007/0068352 | A1 | | 3/2007 | Morgan |
| 2007/0144232 | A1 | | 6/2007 | Shimota et al. |
| 2009/0173204 | A1 | | 7/2009 | Malvestiti et al. |
| 2009/0266209 | A1 | | 10/2009 | Thielges et al. |
| 2010/0107832 | A1 | | 5/2010 | Johnston et al. |
| 2010/0107846 | A1 | | 5/2010 | Lee et al. |
| 2013/0139667 | A1 | | 6/2013 | Lee et al. |
| 2013/0199352 | A1 | | 8/2013 | Thielges et al. |
| 2013/0319200 | A1 | | 12/2013 | Johnston et al. |
| 2014/0331842 | A1 | | 11/2014 | Morehead et al. |
| 2015/0367400 | A1 | | 12/2015 | Endo et al. |
| 2016/0228936 | A1 | | 8/2016 | Villeneuve et al. |
| 2016/0229078 | A1 | | 8/2016 | Thielges et al. |
| 2016/0332319 | A1 | | 11/2016 | Lee et al. |
| 2016/0339502 | A1 | | 11/2016 | Morehead et al. |
| 2017/0291321 | A1 | | 10/2017 | Lee et al. |

FOREIGN PATENT DOCUMENTS

| | | | |
|---|---|---|---|
| CN | 1080607 | | 3/2002 |
| CN | 1360537 | A | 7/2002 |
| CN | 1524020 | A | 8/2004 |
| CN | 1972767 | A | 5/2007 |
| CN | 101060947 | A | 10/2007 |
| CN | 201127968 | Y | 10/2008 |
| CN | 101791653 | A | 8/2010 |
| CN | 102271834 | A | 12/2011 |
| CN | 102271835 | A | 12/2011 |
| CN | 203437498 | U | 2/2014 |
| DE | 1777363 | A1 | 12/1972 |
| DE | 19508091 | C1 | 4/1996 |
| DE | 102006005572 | A1 | 6/2007 |
| EP | 2373442 | A1 | 10/2011 |
| EP | 2373442 | B1 | 1/2016 |
| EP | 3002069 | A1 | 4/2016 |
| EP | 2373441 | B1 | 4/2017 |
| EP | 3195949 | A2 | 7/2017 |
| EP | 3195950 | A2 | 7/2017 |
| FR | 2641486 | A1 | 7/1990 |
| JP | S476475 | Y1 | 3/1972 |
| JP | 54059594 | U | 4/1979 |
| JP | S5555877 | A | 4/1980 |
| JP | S5555877 | Y2 | 12/1980 |
| JP | 57189625 | A | 11/1982 |
| JP | 56113039 | U | 2/1983 |
| JP | S5823221 | B1 | 5/1983 |
| JP | 5989626 | | 6/1984 |
| JP | S61-22698 | | 2/1986 |
| JP | S62109819 | U | 7/1987 |
| JP | 6454923 | | 9/1989 |
| JP | 05192717 | A | 8/1993 |
| JP | H07164070 | A | 6/1995 |
| JP | 3037168 | U | 5/1997 |
| JP | 09174162 | A | 7/1997 |

(56) References Cited

FOREIGN PATENT DOCUMENTS

| | | | |
|---|---|---|---|
| JP | 10244327 | A | 9/1998 |
| JP | 10244331 | A | 9/1998 |
| JP | H11151533 | A | 6/1999 |
| JP | 2000317551 | A | 11/2000 |
| JP | 2001137970 | A | 5/2001 |
| JP | 2002011531 | A | 1/2002 |
| JP | 2002282962 | A | 10/2002 |
| JP | 2004500242 | A | 1/2004 |
| JP | 2006110605 | A | 4/2006 |
| JP | 2006150392 | A | 6/2006 |
| JP | 2006297466 | A | 11/2006 |
| JP | 2007136463 | A | 6/2007 |
| JP | 2007160384 | A | 6/2007 |
| JP | 20050362821 | A | 6/2007 |
| JP | 2008183576 | A | 8/2008 |
| JP | 4913400 | B2 | 4/2012 |
| JP | 5555877 | B2 | 7/2014 |
| WO | 2004024361 | A1 | 3/2004 |
| WO | 2004060620 | A2 | 7/2004 |
| WO | 2010053895 | A1 | 5/2010 |
| WO | 2010053897 | A1 | 5/2010 |
| WO | 2013070536 | A1 | 5/2013 |
| WO | 2013116886 | A1 | 8/2013 |
| WO | 2016130351 | A1 | 8/2016 |
| WO | 2016130530 | A1 | 8/2016 |

OTHER PUBLICATIONS

Applicant Interview Summary and Response to Final Office Action for U.S. Appl. No. 15/204,248, dated Apr. 17, 2017 (9 pages).
Applicant Interview Summary and Response to Non-Final Office Action for U.S. Appl. No. 13/708,318, filed Jul. 28, 2017 (16 pages).
Applicant-Initiated Interview Summary for U.S. Appl. No. 13/708,318, dated Jul. 21, 2017 (3 pages).
Applicant-Initiated Interview Summary for U.S. Appl. No. 15/204,248, dated Apr. 21, 2017 (3 pages).
Final Office Action for U.S. Appl. No. 15/204,248, dated Mar. 24, 2017 (9 pages).
International Preliminary Report on Patentability for International Patent Application No. PCT/US2012/063505, dated May 13, 2014 (7 pages).
International Search Report and Written Opinion of the International Searching Authority for International Patent Application No. PCT/US2009/063058, dated Feb. 17, 2010 (10 pages).
International Search Report and Written Opinion of the International Searching Authority for International Patent Application No. PCT/US2009/063062, dated Feb. 17, 2010 (11 pages).
International Search Report and Written Opinion of the International Searching Authority for International Patent Application No. PCT/US2012/063505, dated Jan. 4, 2013 (11 pages).
Non-Final Office Action for U.S. Appl. No. 13/708,318, dated Mar. 31, 2017 (10 pages).
Non-Final Office Action for U.S. Appl. No. 15/204,248, dated Nov. 23, 2016 (11 pages).
Non-Final Office Action for U.S. Appl. No. 15/631,435, dated Jul. 13, 2017 (9 pages).
Notice of Allowance for U.S. Appl. No. 13/708,318, dated Aug. 21, 2017 (8 pages).
Notice of Allowance for U.S. Appl. No. 15/204,248, dated May 12, 2017 (8 pages).
Response to Non-Final Office Action for U.S. Appl. No. 15/204,248, filed Dec. 16, 2016 (15 pages).
Written Opinion of the International Preliminary Examining Authority for International Patent Application No. PCT/US2016/015940, dated Jan. 17, 2017 (7pages).
Written Opinion of the International Preliminary Examining Authority for International Patent Application No. PCT/US2016/017129, dated Jan. 17, 2017 (6 pages).
International Search Report and Written Opinion for PCT Application No. PCT/US2009/063058 dated Feb. 4, 2010. (9 pages).
International Search Report and Written Opinion for PCT Application No. PCT/US2009/063062 dated Feb. 4, 2010. (10 pages).
European Patent Office, "Extended European Search Report from EP Application No. 15191403.3", dated Mar. 3, 2016, pp. 1-7, Published in: EP.
European Patent Office, "Communication Pursuant to Article 94(3) EPC for EP Application No. 15191403.3", dated May 16, 2019, pp. 1-5, Published in: EP.
European Patent Office, "Communication Pursuant to Rule 62 EPC for EP Application No. 17159111.8", dated Jul. 14, 2017, pp. 1-8, Published in: EP.
European Patent Office, "Communication Pursuant to Rule 62 EPC for EP Application No. 17159137.3", dated Jul. 10, 2017, pp. 1-6, Published in: EP.
Complaint and Jury Demand for Court File No. 17-cv-04608-JRT-BRT, filed by Plaintiff on Oct. 10, 2017 (143 pages).
Defendant Mate Precision Tooling, Inc.'s Answer, Counterclaim, and Demand for Jury Trial for Court File No. 17-cv-04608-JRT-BRT, filed by Defendant on Nov. 22, 2017 (45 pages).
Rule 26(f) Report for Court File No. 17-cv-04608-JRT-BRT, filed jointly by Plaintiff and Defendant on Dec. 1, 2017 (17 pages).
Plaintiff Wilson Tool International Inc.'s Partial Motion to Dismiss Inequitable Conduct Counterclaim for Court File No. 17-cv-04608-JRT-BRT, filed by Plaintiff on Dec. 22, 2017 (4 pages).
Memorandum in Support of Plaintiff Wilson Tool International Inc.'s Partial Motion to Dismiss the Counterclaim for Court File No. 17-cv-04608-JRT-BRT, filed by Plaintiff on Dec. 22, 2017 (26 pages).
Declaration of Anne Rondoni Tavernier in Support of Plaintiff's Motion to Dismiss Inequitable Conduct Counterclaim for Court File No. 17-cv-04608-JRT-BRT, filed by Plaintiff on Dec. 22, 2017 (124 pages).
Mate Precision Tooling, Inc.'s Memorandum Opposing Wilson Tool International Inc.'s Partial Motion to Dismiss Counterclaim for Court File No. 17-cv-04608-JRT-BRT, filed by Defendant on Jan. 12, 2018 (42 pages).
Reply Memorandum in Support of Plaintiff Wilson Tool's Partial Motion to Dismiss the Counterclaim for Court File No. 17-cv-04608-JRT-BRT, filed Jan. 26, 2018 (21 pages).
English Translation of SIPO Search Report (CN201680020843.5) received Dec. 14, 2018 (3 pages).

* cited by examiner

FIG. 7A
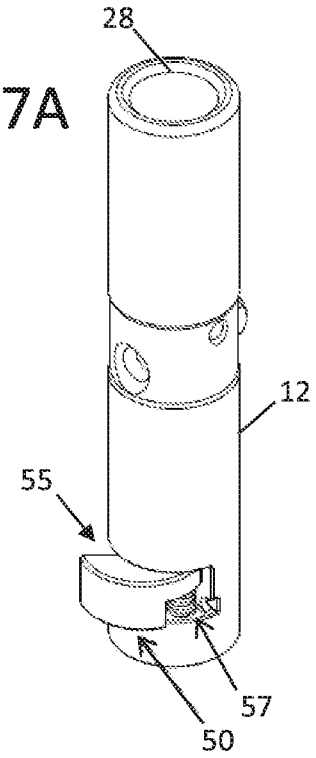
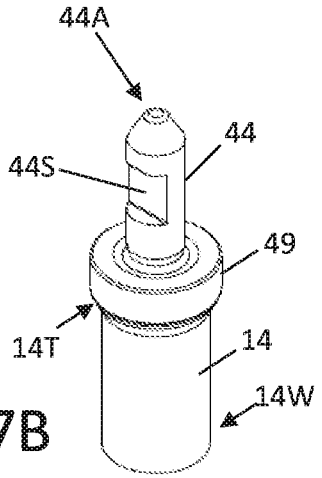
FIG. 7B

FIG. 11A
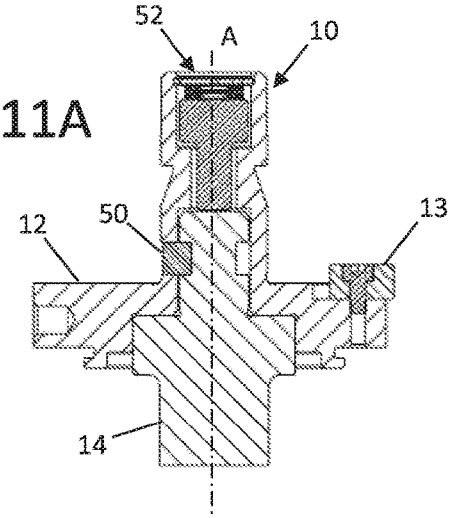
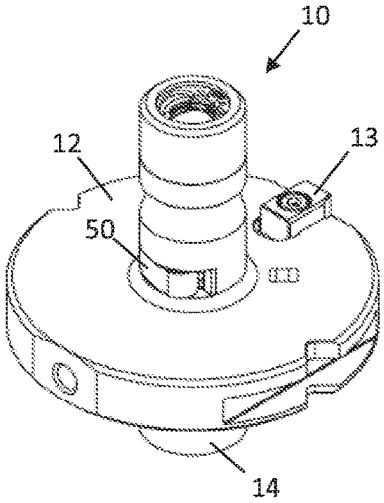
FIG. 11B
FIG. 11C
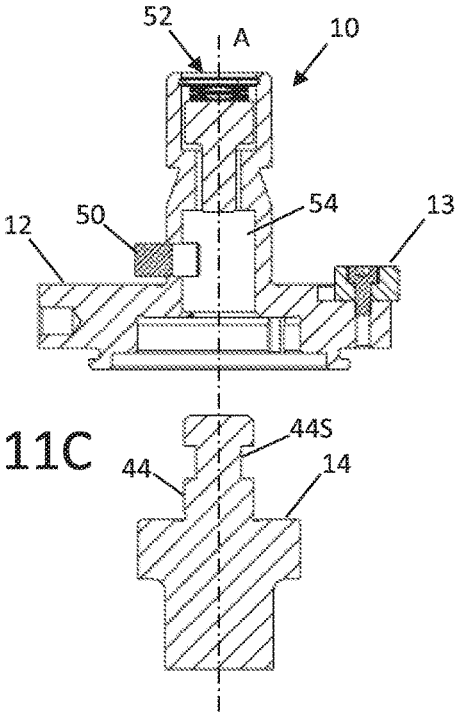
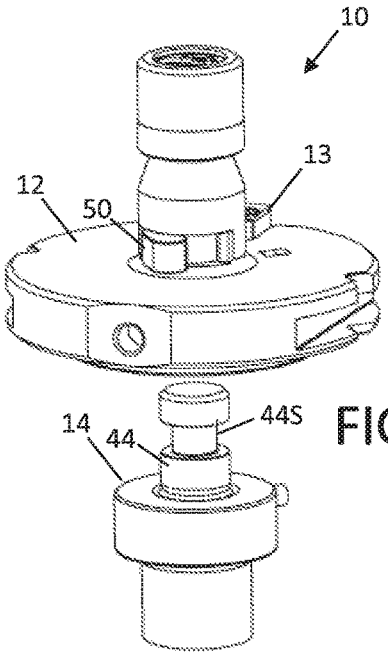
FIG. 11D

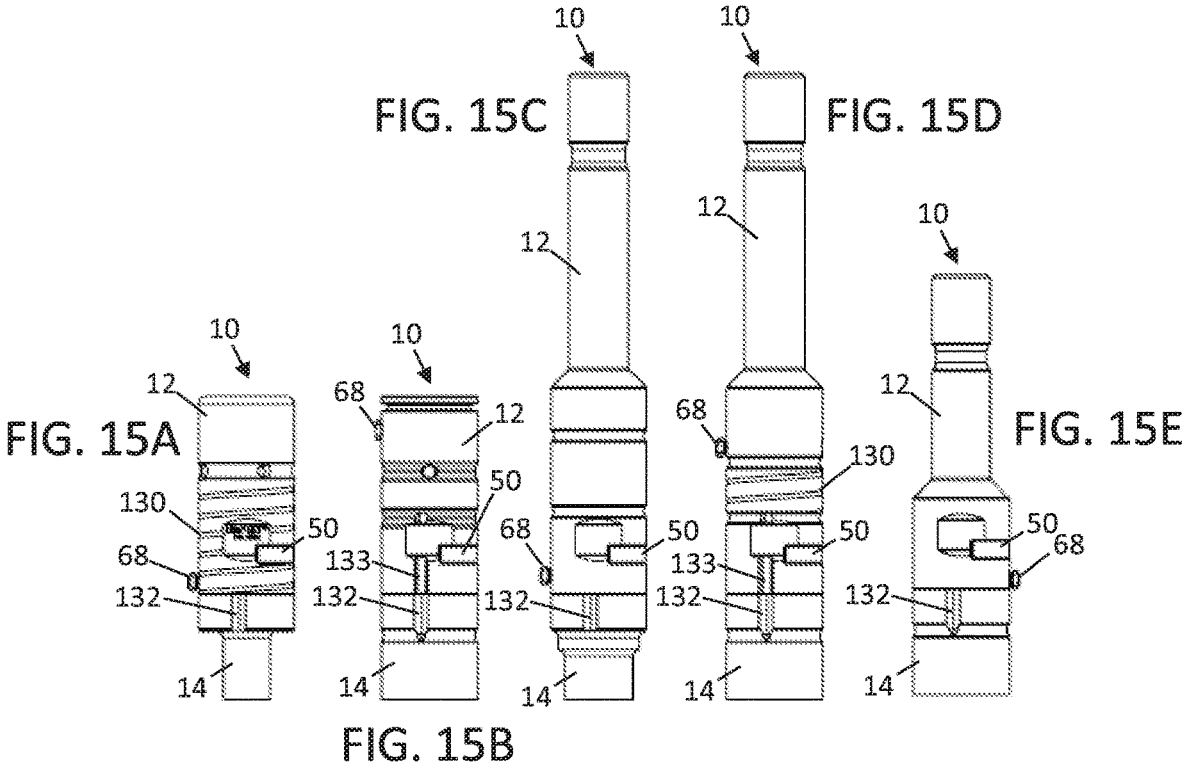
FIG. 15A
FIG. 15B
FIG. 15C
FIG. 15D
FIG. 15E
10
12
14
50
68
130
132
133
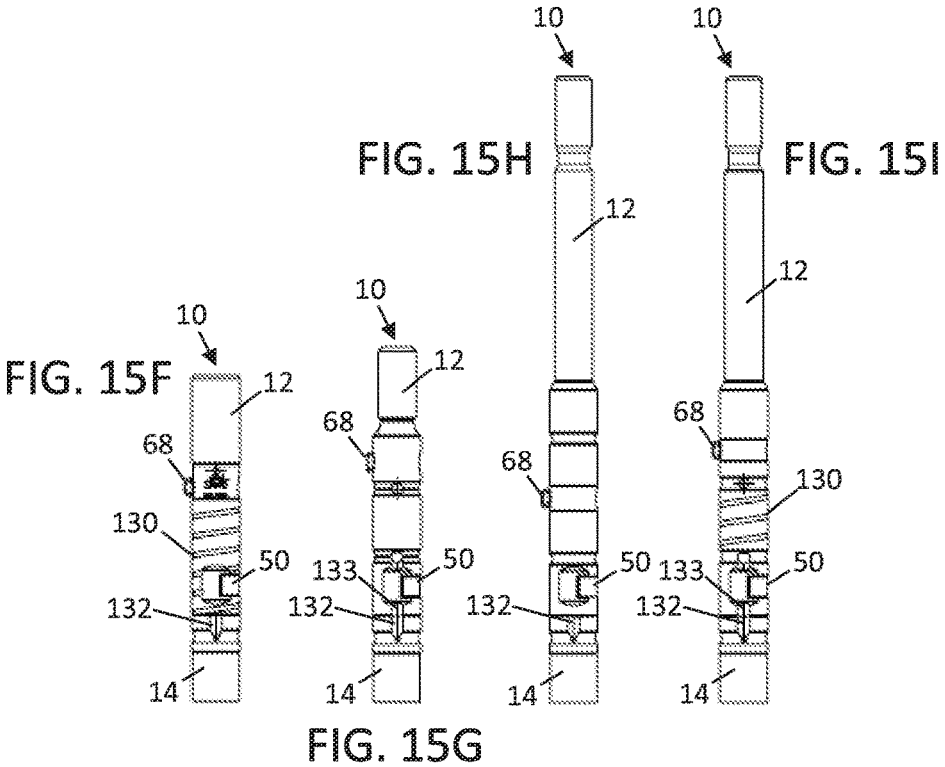
FIG. 15F
FIG. 15G
FIG. 15H
FIG. 15I
10
12
14
50
68
130
132
133

PUNCH ASSEMBLY WITH REPLACEABLE PUNCH TIP

CROSS-REFERENCE TO RELATED APPLICATIONS

This application is a divisional application of U.S. patent application Ser. No. 14/985,863, filed Dec. 31, 2015, now U.S. Pat. No. 10,646,913, which claims priority to U.S. Provisional Patent Application No. 62/113,778, filed Feb. 9, 2015, entitled PUNCH ASSEMBLY WITH REPLACEABLE PUNCH TIP, each of which are incorporated by reference herein, in their entirety and for all purposes.

BACKGROUND

This disclosure relates generally to machine tools, and specifically to punch assemblies, e.g., for metalworking and other applications. The disclosure also relates to punch tool assemblies suitable for use in punch press machines, including, but not limited to, high speed punch presses used in fabrication and manufacturing.

Industrial tooling machines including turret and rail-type punch presses are widely used in the fabrication of sheet metal workpieces and other sheet components (e.g., metal, plastic, leather, etc.). Automated punch presses are commonly employed in manufacturing applications, including single and multi-station presses, press brakes, sheet and coil feed systems, rail-type machine tool systems, and other industrial equipment adapted for pressing, bending and punching sheet components, in order to fabricate sheet metal and other workpieces into a wide range of useful products.

Punch presses in particular have found wide use in sheet metal hole punching and forming applications. Turret presses typically have upper and lower turret sections that hold a series of punches and dies, spaced circumferentially at different locations around the periphery of the turret. The turret press can then be rotated about a vertical axis to bring a desired punch and die set into vertical alignment with a work station, or to bring a series of different punch and die sets sequentially into alignment for performing a series of different pressing operations. Rail-type and single-tool punch presses are also widely used.

The workpiece itself is commonly formed of a piece of sheet metal or other material, disposed between selected punch and die combinations. The punches can be operated under computer control, when the selected punch and die assemblies are suitably aligned across the workpiece. The punch is driven through the workpiece and into the die, forming a hole or other desired feature.

Punch systems typically include an outer punch guide with a punch member reciprocating in a longitudinal bore, or a punch ram assembly with a bushing to hold the punch. The punch itself typically includes a shank or body portion and a punch point or other forming tool on the working end, facing the sheet metal component or workpiece. The punch point engages the workpiece in the punch stroke, forming a hole by driving a slug out of the workpiece and through the die. A return spring or punch clamp can be used to urge the punch back into its original position, in a stripping action following the punch stroke.

A high number of repeated strokes are typical in automated machine tool applications. The punch point may thus become worn, and require sharpening or replacement. There is a constant need to make the replacement process less complex and more efficient, with less downtime and reduced cost.

SUMMARY

A punch assembly is provided, suitable for use in a punch press or similar tooling machine. The assembly includes a replaceable punch tip configured for selective engagement and disengagement with a punch body. Punch press systems using the punch assembly are also encompassed, along with corresponding methods of assembly and operation.

Considerable cost savings can be accomplished by incorporating a shorter high-grade punch tip rather than replacing the entire longer length punch of high-grade material. Depending on configuration, the punch body and punch tip can be coupled by axial engagement between an insert or stem on the punch tip and a corresponding axial cavity in the punch body. Various manual or tool-less coupling mechanisms can be utilized, including, but not limited to, a pivot latch mechanism configured to engage the punch tip step within the axial cavity in a closed position, and to disengage the punch tip from the punch body in an open position.

BRIEF DESCRIPTION OF THE DRAWINGS

FIGS. 7A and 7B are isometric views of the punch body and punch tip, respectively.

FIGS. 11A and 11B are section and isometric views, respectively, of a punch assembly suitable for use in a single-tool or rail-type press apparatus.

FIGS. 11C and 11D are section and isometric views of the punch assembly in FIGS. 11A and 11B, with the punch body and punch tip disengaged.

FIGS. 15A, 15B, 15C, 15D, 15E, 15F, 15G, 15H and 15I are alternate examples of a punch assembly, illustrating a range of size options and other features.

DETAILED DESCRIPTION

Figure 1:
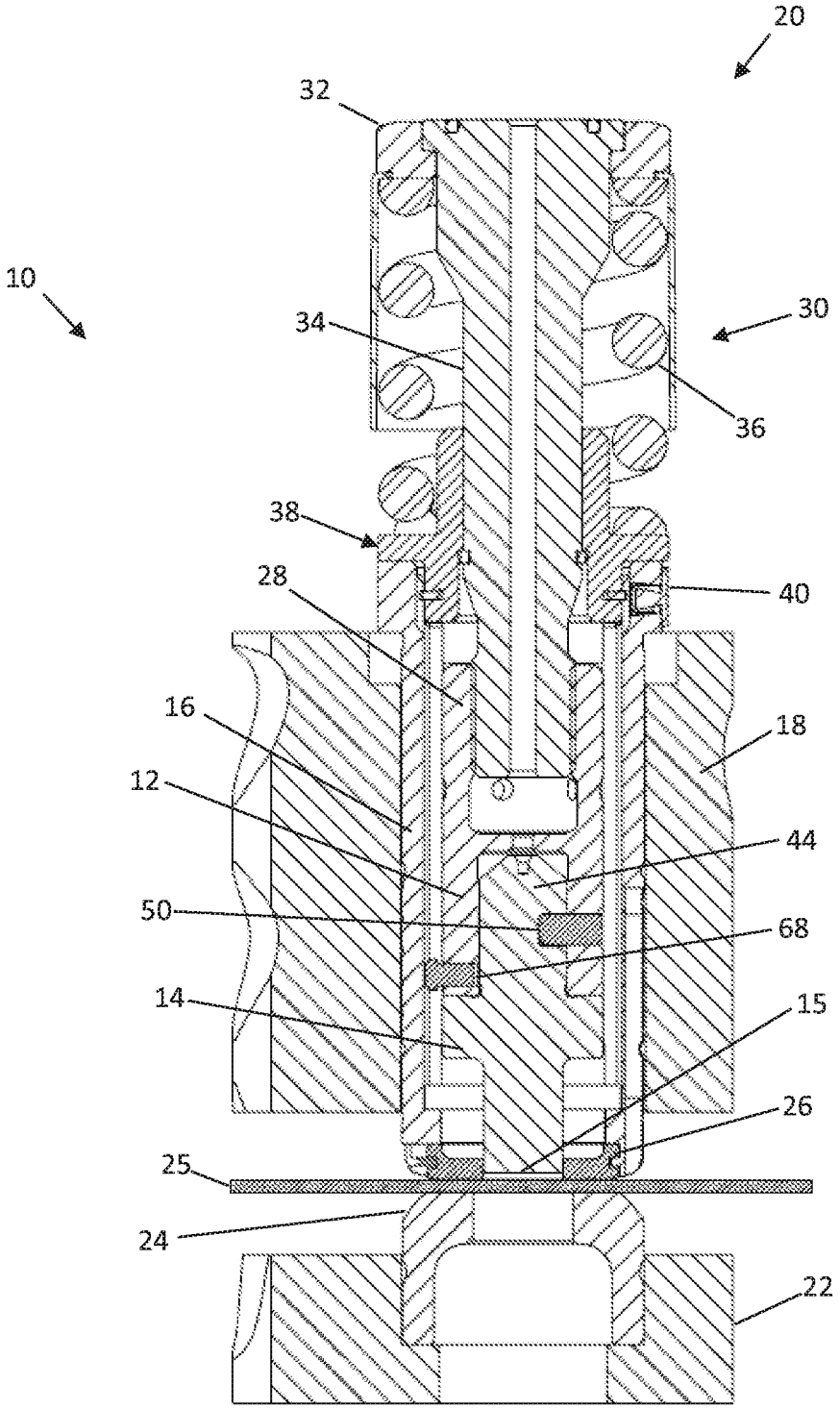
FIG. 1 is a section view of a punch assembly with replaceable punch tip, in a turret-type punch press.

FIG. 1 is a section view of punch assembly 10 with punch body 12 and a replaceable punch tip 14, terminating in punch point 15. In this particular example, punch assembly 10 is disposed within punch guide 16, installed in upper turret 18 of punch press apparatus 20.

Punch press apparatus 20 includes upper turret 18 and lower turret 22. Die 24 is mounted in lower turret 22, opposite punch tip 14 across workpiece 25, for example a sheet metal component or other material to be tooled.

In operation of punch assembly 10, punch point 15 of punch tip 14 is driven through an aperture in stripper 26 on the bottom surface of punch guide 16, extending through workpiece 25 and into die 24. Punch point 15 separates a slug from workpiece 25 during the punching process, and the slug is received into die 24. Stripper 26 is disposed on the bottom surface of punch guide 16, and holds workpiece 25 in place as punch point 15 is withdrawn from die 24. Alternatively, press apparatus 20 and die 24 may be configured for notching, slitting, shearing, or blanking workpiece 25, or for other metal forming processes.

A threaded connection or other mechanical coupling 28 couples punch body 12 to punch canister assembly 30, with punch head 32, punch driver 34 and stripping spring 36. A ram component of punch press apparatus 20 imparts an axial (e.g., downward) force onto punch head 32, driving punch driver 34 through an aperture in spring retainer plate 38 by a distance sufficient for punch point 15 to penetrate workpiece 25 into die 24, as described above. When the ram is retracted (or the driving force on the ram is removed), stripping spring 36 acts between spring retainer plate 38 and punch head 32, moving punch driver 34 back (e.g., upward) to its original position. Punch tip 14 is withdrawn from die 24 and workpiece 25 back into punch guide 16, with punch point 15 positioned within (and no longer extending from) the aperture in stripper member 26, as shown in FIG. 1.

Depending on embodiment, a pushbutton or other mechanism 40 may be provided to adjust punch length of punch assembly 10, as measured to punch tip 14 and punch point 15. A radial member or anti-rotation key 68 may also be provided in various locations along punch body 12, in order to orient the angular position of punch body 12 with respect to the guide or bushing 16, as described below. Additional features suitable for application in punch press apparatus 20 are disclosed in U.S. Pat. Nos. 5,839,341, 5,884,544, and 7,975,587, currently assigned to Mate Precision Tooling of Anoka, Minn., each of which is incorporated by reference herein, in the entirety and for all purposes.

FIG. 1 illustrates a two-part punch configuration, in which a removable and replaceable punch tip or lower portion 14 of punch assembly 10 is coupled to the punch body or upper portion 12. Small, replaceable punch tips 14 can be made from high performance tool steel and other suitable materials at relatively low cost, and changed in and out when worn, or when a new punch tip configuration is desired. Replaceable punch tips 14 can also be configured for toolless manual operation, so that they can be removed, exchanged and locked back into place manually and without special tools, or without any tools at all, as described herein.

In one particular example, punch tip 14 is secured to punch body 12 using a latch mechanism, as shown in FIG. 1, with replaceable punch tip 14 secured by a pivot latch 50 or similar retention mechanism provided on punch body 12, and configured for selective engagement with tang or stem 44 of punch tip 14. The pivot latch mechanism is described in various additional embodiments, as detailed below.

Figure 2:
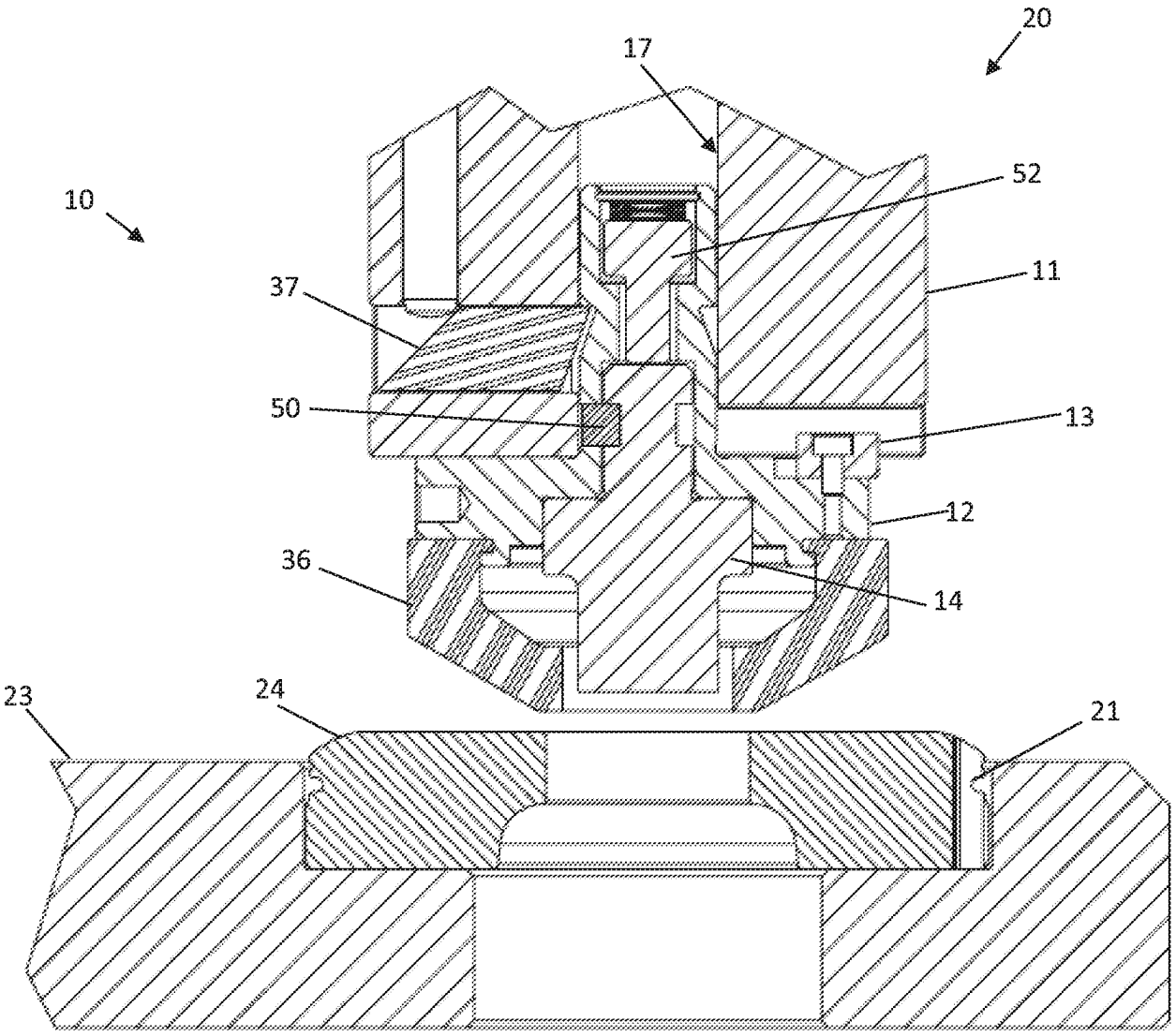
FIG. 2 is a section view of a punch assembly with replaceable punch tip, in a single tool or rail-type punch press.

FIG. 2 is a section view of punch assembly 10 with replaceable punch tip 14, in single-tool or rail-type press apparatus 20. In this configuration, punch 10 is mounted in press ram assembly 11, and a threaded coupling to a punch canister is not necessarily required. Instead, press ram assembly 11 includes an internal bushing 17 or similar structure configured to retain punch body 12 and punch tip 14 in vertical alignment along the punch axis. Both punch 10 and die 24 can be provided with angular keying, for example punch keying 13 and die keying 21.

In punching operation, press ram 11 is actuated to drive the working end of punch insert 14 through the workpiece, and into engagement with die 24 in die holder 23. In the rail-type configuration of FIG. 2, punch press apparatus 20 may utilize a urethane stripper member 36, with punch tang clamp 37 configured to apply the stripping force when punch tip 14 is withdrawn from die 24. Additional features suitable for application in such a punch press apparatus 20 are disclosed in U.S. Pat. No. 4,951,375, which is incorporated by reference herein, in the entirety and for all purposes.

In one particular example, punch tip 14 is secured to punch body 12 using a pivot latch mechanism 50, as shown in FIG. 2. A vertical (or axial) ejector pin or similar (e.g., spring-loaded) ejector member 52 can be disposed within punch body 12. For example, ejector 52 may be disposed along the axis of punch body 12, and configured to urge punch tip 14 out of axial engagement with punch body 12 when punch assembly 10 is removed from punch press apparatus 20, and pivot latch 50 is manipulated from the closed or locked position to an open or unlocked position. Alternatively, a pin-connected mechanism can be utilized with ejector 52, or other arrangement for releasable coupling of punch tip 14 to punch body 12.

Figure 3A:
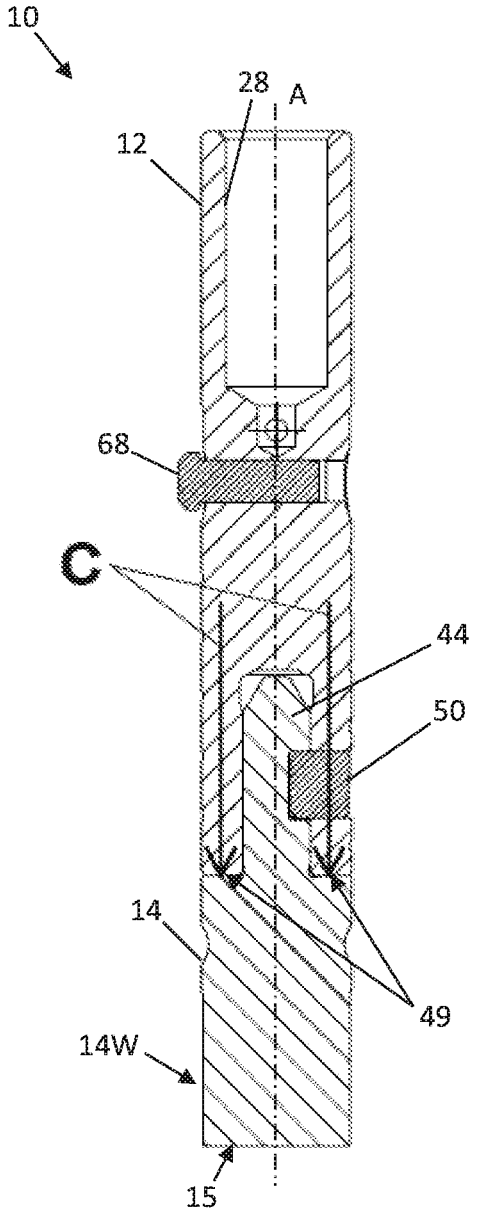
FIGS. 3A and 3B are section views of the punch assembly, illustrating compression and strip loading.
Figure 3B:
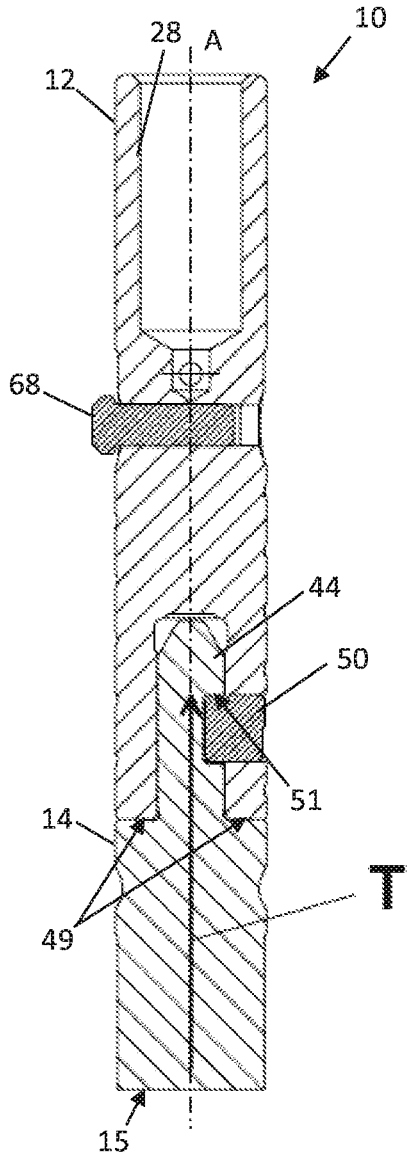

FIG. 3A is a section view of the punch assembly, illustrating compression loading during a punching operation. FIG. 3B is an alternate section view of the punch assembly in FIG. 3A, illustrating strip loading during the punch retraction portion of the punch operation. An anti-rotation key 68 can also be provided in punch body 12, and configured to engage a corresponding slot on the inner surface of the punch guide or bushing to orient punch body 12 with respect to the punch press. Suitable keys 68 may also be provided in different locations on punch body 12 (e.g., above or below latch mechanism 50), or directly on punch tip 14.

As shown in FIG. 3A, the force required to perform a punch operation flows generally axially from (e.g., threaded) coupling 28 at the top of punch device 10, down through the punch driver (or punch body 12) to punch point 15 on working end 14W of punch tip 14. As punch assembly 10 travels downward to punch a hole in the sheet material or workpiece, the workpiece pushes back upward against punch point 15, introducing a substantial compressive loading C between punch tip 14 and punch body 12. The punch loading can easily exceed several tons, depending on punch size, and the working material composition and thickness.

To avoid or reduce the chance for damage or deformation of coupling mechanism 50 during the punch stroke, compressive loading may be directed to the contact surfaces 49 defined between punch body 12 and punch tip 14, for example by maintaining clearance between stem 44 and the axial cavity in punch body 12, or other relevant coupling structures. Thus, the load may be directed to the interface between the top surface of the flange or ledge surfaces 49, extending circumferentially about stem 44 on punch tip 14, and complementary corresponding surfaces on the bottom surface of punch body 12, extending around the axial cavity in which stem 44 is engaged. Note that there may be some gaps along the load-bearing surfaces (e.g., due to the alignment features), but these are typically small in relation to the load-bearing surface area, in order to maintain the strength and integrity of punch device 10. An elastic member may also be configure to provide a bias between punch tip stem 44 and punch body 12, as described below, outside the compressive loading path.

As shown in FIG. 3B there is also loading during the stripping operation, due to friction of the punch tip with the material being punch or when punch point 15 sticks in the sheet material (or other workpiece) when punch tip 14 is retracted. This generates a tension load T (rather than a compressive load) at surface 51, between punch tip stem 44 and pivot latch member 50. The magnitude of tension load T during the stripping operation is typically several times less than that of compressive loading C during the punch stroke. Nonetheless, the stripping load can be extensive, and the corresponding tension forces may be transferred through the coupling between punch tip stem 44 and the pivot latch or other coupling mechanism 50, as shown in FIG. 3B.

To address these very different punching and stripping loads, punch 10 must provide a combination of compressive loading surfaces 49 defined across punch axis A, along the contact interface between punch body 12 and punch tip 14, and a coupling mechanism with sufficient strength to withstand the smaller but still substantial tension loads introduced along axis A, when punch point 15 is withdrawn from the sheet metal workpiece, in the stripping portion of the punch operation. In this particular embodiment coupling mechanism 50 and punch tip stem 44 are configured to maintain the coupling between punch body 12 and punch tip 14 under a tension loading on the order of at least a few tons, or more. The coupling and load-transfer structures should also be configured to withstand the different compression and tension loads over extended period of operation, including many thousands or even millions of punch cycles, executed over weeks and months of continuous operation, and years of accumulated service time.

Figure 4A:
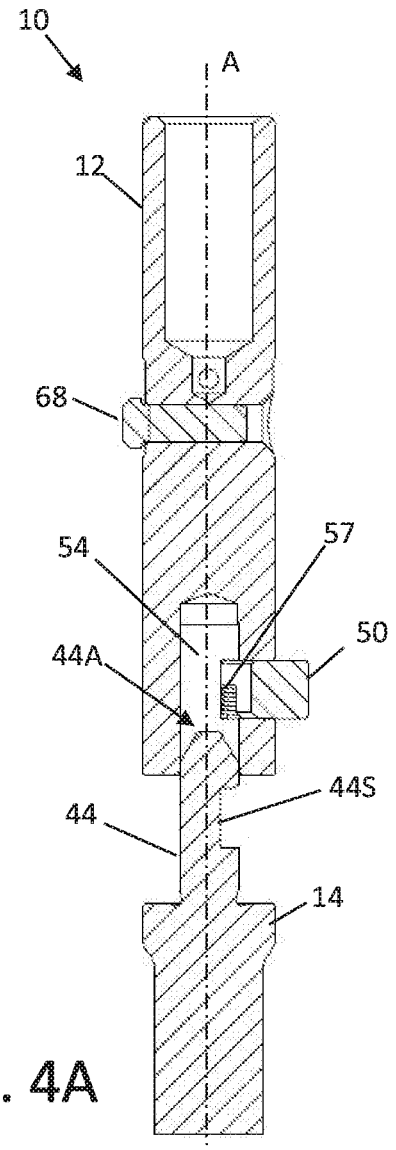
FIGS. 4A and 4B are section views of the punch assembly, with a pivoting latch mechanism.
Figure 4B:
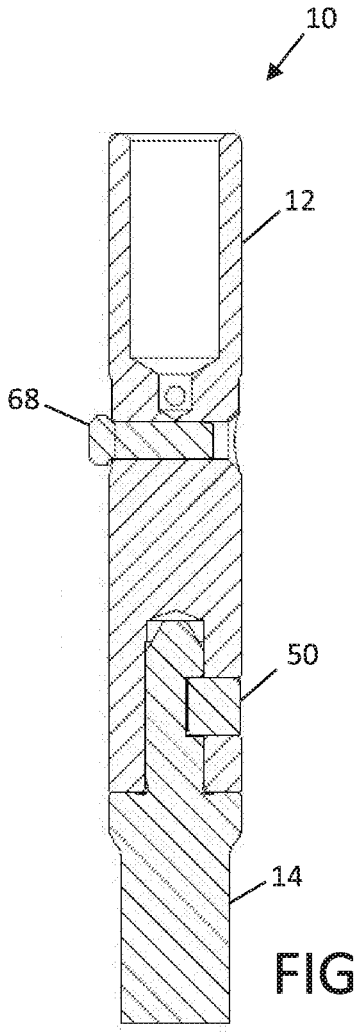

FIG. 4A is a section view of punch assembly 10, for example with a spring-loaded pivot latch mechanism 50. FIG. 4B is an alternate section view of punch assembly 10, with pivot latch 50 closed for coupling removable punch tip 14 to punch body 12.

As shown in FIGS. 4A and 4B, two-part punch assembly 10 for use in a punch press is divided into a removable punch tip lower portion 14, held into punch body upper portion 12, and locked in place by a pivoting latch 50. Punch tip 14 is locked in place with respect to punch body 12 without elastic or cam features, and pivot latch 50 is easily operated manually and without tools, e.g., with a spring-loaded mechanism 57, or using a non-spring loaded design. Relatively small, removable punch tips can be made from tool steel or other high performance material at relatively low cost, as compared to a single-piece punch assembly with the punch body and tip formed of the same material.

Features of this design that are not found in the prior art punching industry include using a lever or latch 50 configured to allow installation of the punch tip or insert 14 by simply pushing stem 44 into axial cavity 54 in punch body 12. One does not necessarily need to open pivot latch 50 in order to install punch tip 14, because the cone-shaped end 44A of the shank or stem 44 on punch tip 14 is configured to spread open latch 50. To release punch tip 14, pivot latch can be opened by hand, manually and without tools. Precise angular keying can be provided by an alignment pin and precision slot arrangement, as described below.

Figure 5A:
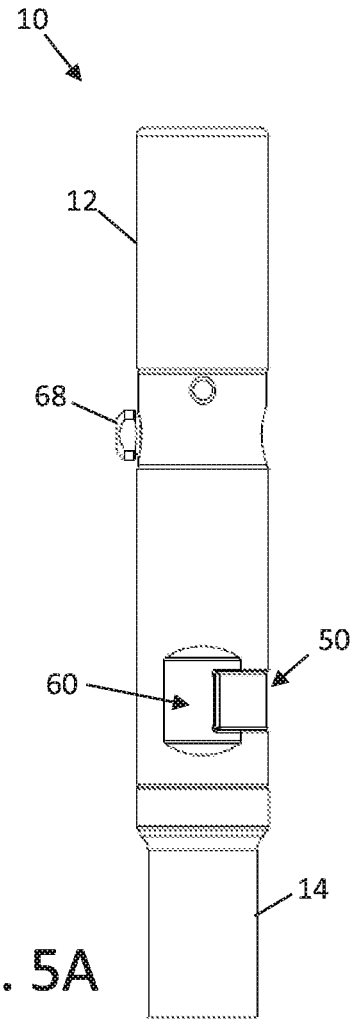
FIGS. 5A and 5B are side and isometric views of the punch assembly, respectively, with the latch in a closed or engaged (locked) position.
Figure 5B:
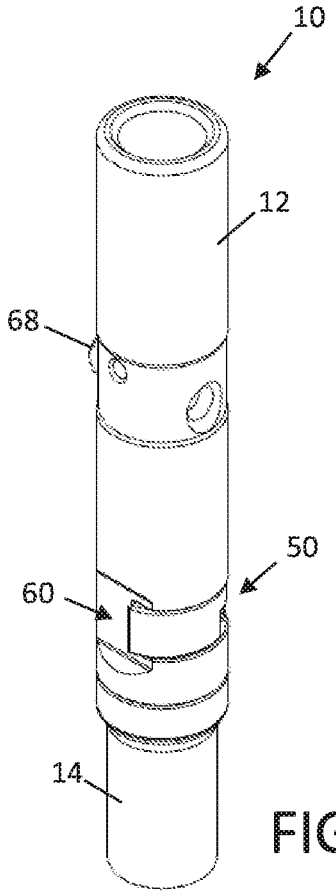

FIG. 5A is a side view of punch assembly 10 with pivot latch mechanism 50 in a closed or engaged (locked) position. FIG. 5B is an isometric view of punch assembly 10 as shown in FIG. 5A, also showing relief cavity or recess 60 which allows for easy access to the free end of latch member 50 for manual engagement; e.g., with the thumb or fingers for actuating the latch mechanism.

Figure 6A:
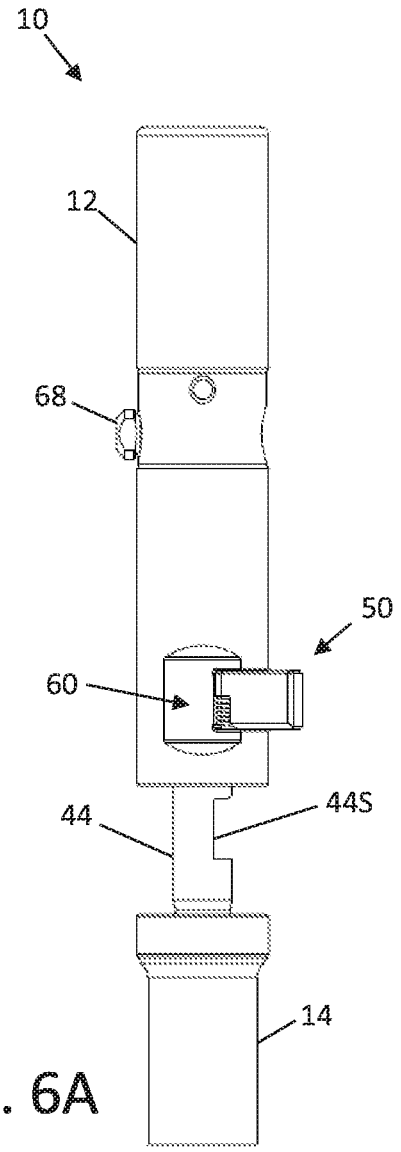
FIGS. 6A and 6B are side and isometric views of the punch assembly, respectively, with the latch in an open or disengaged (unlocked) position.
Figure 6B:
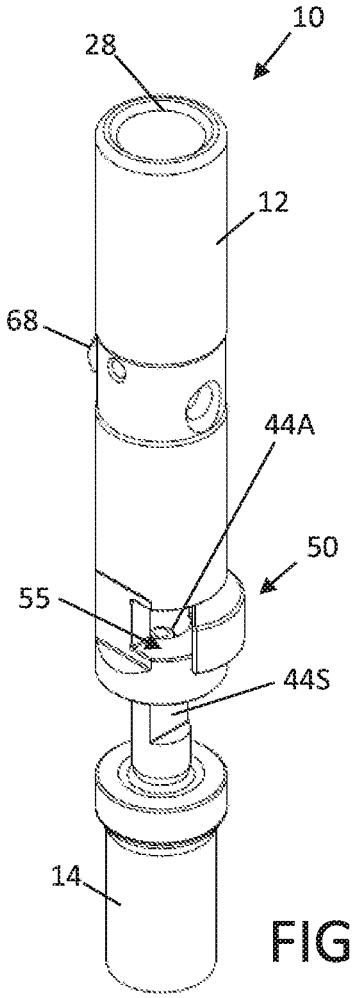

FIG. 6A is a side view of punch assembly 10 with pivot latch mechanism 50 in an open or disengaged (unlocked) position. FIG. 6B is an isometric view of punch assembly 10 as shown in FIG. 6A. In this embodiment, the pivot latch mechanism can be temporarily held open with the thumb or fingers.

As shown in FIGS. 5A, 5B, 6A and 6B, punch assembly or punch device 10 embodies a two-piece or hybrid design, with removable punch tip 14 attached to a special "holder" or punch body 12, making up the remainder of what would otherwise be a complete punch assembly 10, such as used in a punch press. Such removable punch tip 14 are desirable in the industry at least because relatively smaller punch tips can be made of high performance material at a reasonable cost, whereas making the entire punch assembly 10 of such material would be more costly, and possibly cost-prohibitive, at least for many common punch press applications.

Installation of Punch Tip into Punch Body

In some embodiments, punch assembly 10 may be provided as a premium adjustable-length punch device, with punch body 12 having a threaded top or similar coupling 28 and a vertical hole or axial cavity 54 in the bottom surface (see FIG. 4A), configured for accepting precision shank or stem 44 of punch tip 14. Pivot latch 50 is resiliently fastened on a pivot at one end of pocket 55 in the side of punch body 12 (FIG. 6B), so that when pivoted inward latch 50 will extend into a portion of the axial cavity where it can engage slot 44S on punch tip stem 44, coupling or releasably fastening punch tip 14 onto punch body 12.

It should be observed from the component and feature descriptions above that pivot latch 50 can be rotated outward to a position where slot 44S in punch tip stem 44 would be allowed to move vertically (axially) into engagement or past pivot latch 50, thus facilitating installation and removal of punch tip 14. Punch tip 14 is locked in place for punching operation when pivot latch 50 is fully rotated inward, within or conforming to the outer diameter of punch body 12. Punch assembly 10 can then be installed in a punch guide, bushing, or similar punch press component, where the walls of the punch guide or bushing securely constrain pivot latch 50 in the closed or locked position, which does not allow for pivot latch 50 to rotate out of punch body 12.

Removal of Punch Tip from Punch Body

Punch assembly 10 can be separated by manually rotating pivot latch 50, e.g., by pulling or pushing the free or moving end of latch 50 outward, into the open or disengaged position. When rotated out far enough, the inner portion of pivot latch 50 will no longer engage notch 44S in punch tip stem 44, allowing punch tip 14 to be pulled out and separated from punch body 12 by removing stem 44 from axial cavity 54. A further enhancement encompasses providing a vertical spring or other ejection system disposed within punch body 12, pressing resiliently on punch tip stem 44 so that punch tip 14 is ejected when pivot latch 50 is rotated to the open position (see, e.g., FIG. 11A).

With latch 50 in the open position, punch tip 14 can be pulled out of or ejected from punch body 12, e.g., using one hand for manipulating latch 50 and another for removing punch tip 14. A physical stop can also be included on latch 50, and configured to mechanically impede latch from opening too far and so as to prevent damage to latch member 50 and/or optional spring 57.

As can be seen in the various assembly views and part drawings, punch tip stem or tang 44 has a generally linear or arcuate half-cylinder or D-shaped cavity or slot 44S, with surfaces extending substantially perpendicular to punch body axis A, which accepts similarly-shaped pivot latch member 50 to secure punch tip 14 to punch body 12. When pivot latch 50 is completely rotated into punch body 12, the inner portion of latch member 50 is engaged with the D-shaped slot 44S on the punch insert or stem 44, in the installed or closed and engaged (locked) position.

Pivot Latch 50 can also be manually rotated to an open or unlocked position, where the inner portion of latch 50 does not engage slot 44S or punch tip stem 44, allowing installation or removal of punch tip 14. This allows employment of a relatively smaller punch tip device 14, which can be easily installed on, replaced, and/or removed from punch body 12, manually and without tools.

FIG. 7A is an isometric view of punch body 12, showing the configuration of pivot latch 50 with a torsion spring 57 (on a hinge pin) and latch cavity or pocket 55 (back side; see also FIG. 6B). FIG. 7B is an isometric view of punch tip 14, showing the configuration of punch tip stem or tang 44. As shown in these figures, the punch assembly includes three main parts: punch tip 14, punch body 12 and pivot latch 50. While a spring 57 may be provided as part of this particular embodiment, e.g., in order to keep latch 50 closed while outside the punch guide, spring 57 is not necessarily required, and spring 57 is not necessarily configured to hold latch 50 closed during punching operations. This function may be implemented by the inner punch guide wall, which abuts the outer diameter of punch body 12 in order to securely retain latch 50, and to prevent the punch tip disengagement mechanism from being actuated.

Punch Tip

In some embodiments, punch tip 14 has a cylindrical shank or tang 44 extending from flange 49 at top end 14T, opposite working end 14W (e.g., with the punch point). Stem 44 is somewhat smaller in size than the outer (or outside) diameter (OD) of punch tip part 14. Thus, the ledge or flange portion 49 is provided for mating with corresponding surfaces on the lower portion of punch body 12, for transferring load or transmitting the punching force to punch tip 14. Stem 44 has a radial or horizontal slot or groove 44S on one side, such as could be created by notching out part of the stem diameter in a direction perpendicular to the punch tip axis. Slot 44S is configured to receive pivot latch member 50, as described below, by which to releasably secure punch tip 14 to punch body 12.

The lower or working end 14W of punch tip 14 can be configured substantially the same as or similar to that of a complete one-piece punch currently found in the industry, where the point is shaped to create a hole in the material to be punched. In some embodiments, alignment features can also be provided for precise angular orientation of punch tip 14 with punch body 12, as described below.

For axial positioning, the outer diameter of punch tip 14 may be defined sufficiently precisely to center punch tip 14 with respect to a punch guide. Alternatively the diameter may be slightly smaller (or have greater tolerance) to provide clearance to the inside of the punch guide or bushing, allowing stem or tang 44 of punch tip 14 to achieve precision centering. Both centering methods could also be used, for a system with redundant constraints. Precision centering is desired, e.g., for efficient punching of thin materials that require a tight fit between the punch and die size.

Punch Body

In some embodiments, punch body 12 may have a thread feature or similar coupling on the upper receiving end, for coupling and operation in a punch press. A radial protruding orientation key or key pin can also be provided for angular orientation with respect to a punch guide or bushing.

On the lower end, punch body 12 has a cylindrical axial cavity 54 configured for receiving axial shank or stem 44 of punch tip 14 (see also FIGS. 4A, 5A, 6A). The axial cavity may be located to high precision with respect to the outer (or outside) diameter (OD) of punch body 12, so as to locate punch tip 14 on the central axis. Other structures can also be used for precision locating, as is detailed in the further description of punch tip 14.

Pivot Latch

To secure punch tip 14 axially relative to punch body 12, a half-cylinder or generally D-shaped pivot latch 50 pivots within a similarly shaped cavity in punch body 12, about a pivot axis near the outer diameter of punch body 12, so that in the closed position the inner portion of latch 50 engages notch 44S in punch tip stem 44, securing punch tip 14 to punch body 12 so that they operate as a solid punch assembly 10 moving slidably within the punch guide or bushing. Latch 50 pivots on a pin or hinge which is pressed into punch body 12 and holds both latch 50 and torsion spring 57, e.g., which urges latch 50 toward the closed position, with the outer surface of latch 50 conforming to or recessed within the outer diameter of punch body 12.

In some embodiments, the half-cylinder, D-shaped or other conforming pivot latch 50 is held in place by a pin pressed into punch body 12, with torsion spring 57 urging latch 50 toward central axis A of punch body 12. In the closed position, latch 50 fits within a similar shaped (e.g., half-cylinder or D-shaped) latch pocket 55 in punch body 12. Alternately, latch 50 and pocket 55 could have any suitable similar or matching shapes, so that latch 50 conforms to the outer diameter of punch body 12 when closed. Suitable pivot latches 50 can also include a chamfered bottom edge, to ease installation of punch tip 14. The chamfer features on punch tip stem 44 and the lower edge of pivot latch 50 work against the action of torsion spring 57, so that latch 50 is compelled to pivot open to allow punch tip stem 44 to fully engage when pressed into the axial cavity in punch body 12, with torsion spring 57 returning latch 50 to a closed or locked position when punch tip 14 is fully engaged with punch body 12.

Angular Orientation

Figure 8A:
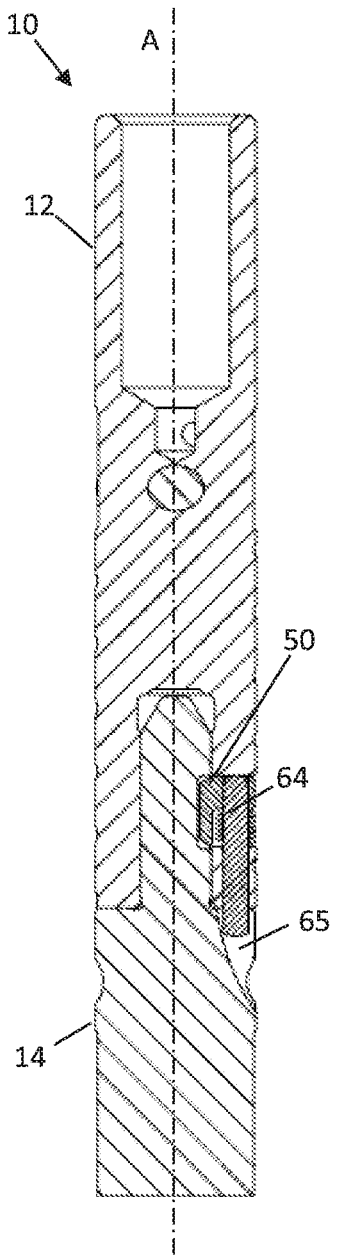
FIG. 8A is a section view of a punch assembly, illustrating the alignment configuration.

FIG. 8A is a section view of punch apparatus 10, illustrating the alignment features. As shown in FIG. 8A, a curved or angled orientation slot 65 is provided in punch tip or insert 14, which is oriented using the same pin 64 in the driver or punch body 12 used for pivoting the latch mechanism 50, and holding the spring.

For example, an axially-oriented precision alignment dowel pin 64 may be engaged via a curved or angled slot 65. In this embodiment, a single pin 64 can be used as both a latch pin configured for manipulation of mechanism 50 (or adapted to facilitate rotation thereof by engagement with the free end; e.g., within a recess thereof), and also doing double duty as the orientation pin protruding into precision slot 65 in the upper flange portion of punch tip 14. Alternately, a second pin may be disposed projecting vertically out the bottom of punch body 12, and configured for orientation into a corresponding punch tip precision slot or hole 65 for orienting punch tip 14 to punch body 12, as described below. Thus, two separate pins could be used, one for orientation of punch tip or insert 14 with respect to the driver or punch body 12, and another for manipulating latch mechanism 50.

Figure 8B:
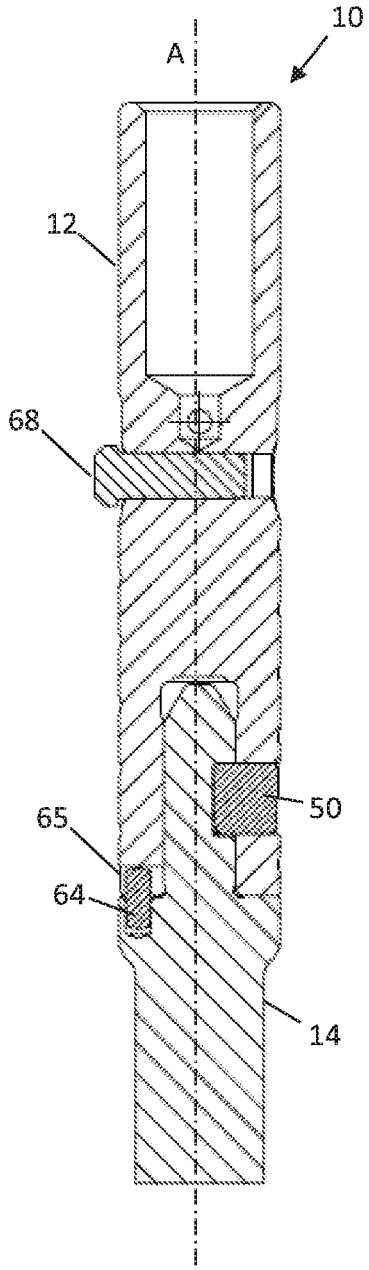
FIG. 8B is a section view of a punch assembly, with alternate keying and alignment features.

FIG. 8B illustrates an alternate configuration in which punch tip 14 is oriented with respect to the driver or punch body 12 via an orientation pin 64 pressed into the top surface of the punch tip 14, instead of the driver or punch body 12. Conversely, precision alignment slot 65 is formed in the bottom of punch body 12, rather than punch tip 14. Alternatively an axially engaged pin 64 may be provided in the bottom of punch body 12 for engagement with a corresponding slot or hole 65 in punch tip 14, as described above.

Figure 8C:
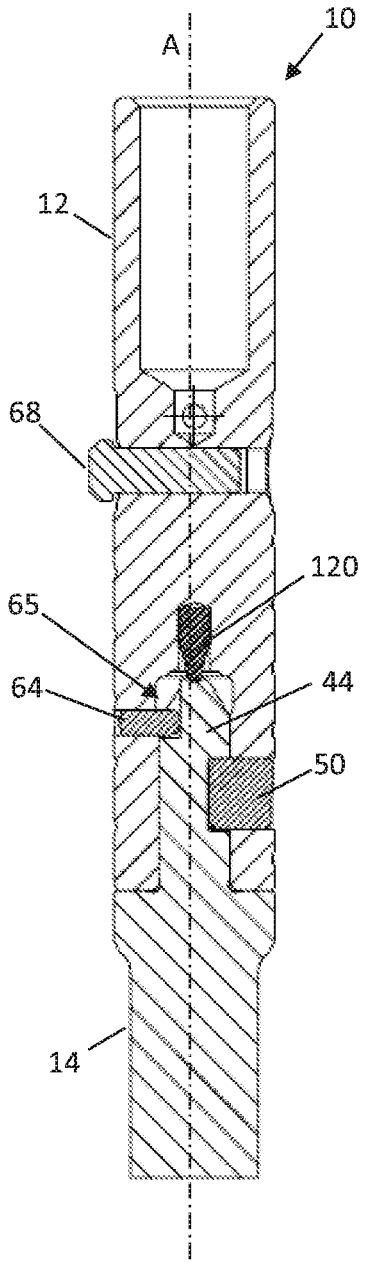
FIG. 8C is a section view of a punch assembly, with an elastic "bumper" coupling between the punch body and punch tip stem, and an alternate alignment pin configuration.

FIG. 8C is a section view of punch apparatus 10, with an elastic bumper member 120 configured to generate bias and reduce or minimize relative motion (or "jiggle") of the punch tip insert (or punch insert) 14 with respect to the punch body (or punch driver) 12. Compression (C) and tensile (T) loadings are also illustrated, as experienced in the punching and stripping phases of press operation, respectively.

In the alternate example of FIG. 8C, pivot latch coupling mechanism 50 is provided with a laterally-oriented alignment pin 64 and slot 65 to provide precision angular alignment between punch tip 14 and punch body 12. The punch tip or insert 14 is oriented with respect to the punch driver or punch body 12 by engaging a slot 65 in the upper shank (or insert stem) 44 with a horizontal pin 64 inserted in the lateral or radial direction, from the outer side of the driver or punch body 12. Similarly, instead of using an alignment pin 64 and slot 65 to orient the insert or punch tip 14 with respect to punch body 12, latch mechanism 50 could also be formed with sufficient precision to provide the desired precision in angular orientation.

Elastic Bumper Member

Elastic bumper member 120 is provided as a rubber or plastic (polymer) member, which is positioned along punch axis A of punch assembly 10, and disposed between punch driver 12 and the upper surface of punch tip 14 (that is, within the axial cavity where the stem or tang of punch tip 14 is received in punch driver or body 12). One end of bumper 120 can be formed as an elongated elastic member inserted into an axial hole extending upward from the bottom cavity in punch body 12. The other end of bumper 120 contacts the upper surface of punch tip 14, in a compressive or resilient coupling or bias engagement to reduce relative motion. Alternatively bumper member 120 can have any suitable configuration, including, but not limited to, an O-ring or resilient disk.

Bumper member 120 can be formed of elastic materials such as plastic or rubberized polymer, or provided as a resilient (e.g., spring) bias element, which is positioned to dampen or reduce relative motion between punch driver or punch body 12 and removable punch tip or insert 14. Bumper member 120 is configured to provide sufficient resilient bias (e.g., outward bias) to reduce "jiggle," shaking, wiggling, and other motion of punch tip 14 with respect to punch body 12, e.g., due to vibration or during assembly of punch apparatus 10. At the same time, bumper member 120 can also be substantially isolated from the punch and stripping load paths C and T, as described above.

Bumper 120 is formed a resilient member positioned between punch body 12 and the upper surface of punch tip 14, where the stem is received within the axial cavity in the bottom of the punch body (or punch driver) 12. For example, bumper member 120 can be provided in a substantially compressive coupling or biasing relationship between punch body 12 and the upper surface of punch tip 14. Depending on configuration, one or both of punch body 12 and punch tip 14 can be provided with grooves, chamfers or other surface features configured to receive bumper member 120, and to help retain bumper member 120 in a suitable position between punch body 12 and punch tip (or punch tip insert) 14.

Figure 9A:
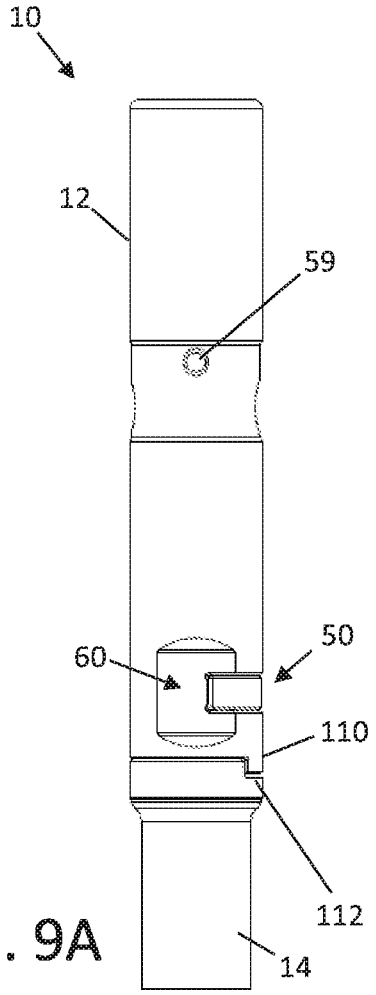
FIGS. 9A and 9B are side and isometric views of the punch assembly, respectively, with additional precision rotational alignment features.
Figure 9B:
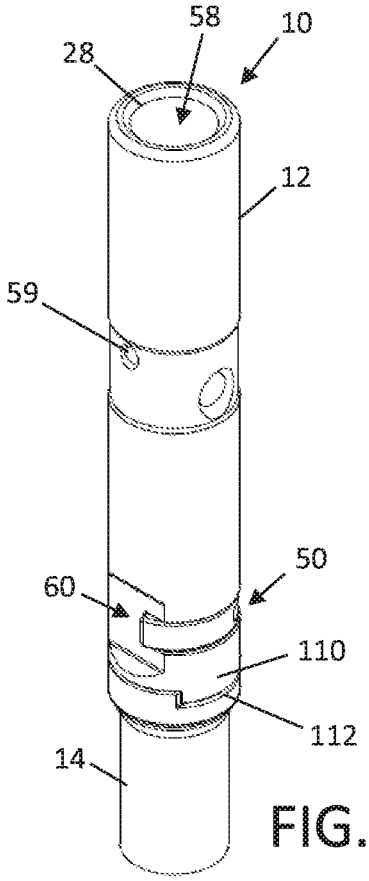

FIG. 9A is a side view of punch assembly 10, showing an alternate precision alignment protrusion 110 on punch body 12, and a corresponding slot or cut-out 112 on punch tip 14. FIG. 9B is an isometric view of punch assembly 10 as shown in FIG. 9A.

Complementary precision alignment features such as a machined protrusion 110 and cut-out 112 can be provided integral to or formed on the bottom end of punch body 12 and the top end of punch tip 14, respectively, e.g., parallel to punch axis A and at a maximal radial distance from the punch center. Complementary protrusion features 110 and cut-out features 112 can be milled flat or otherwise configured for engagement along an outer diameter or circumference of punch body 12 and punch tip 14, and adapted to allow precise angular orientation to be transferred between punch body 12 and punch tip 14, e.g., when precision cut-out 112 on punch tip 14 engages precision orientation protrusion 110 on punch body 12. Alternately, alignment protrusion 110 and cut-out 112 can be reversed, and provided for precision alignment by similar engagement along the abutting surfaces of punch tip 14 and punch body 12, respectively.

Figure 10A:
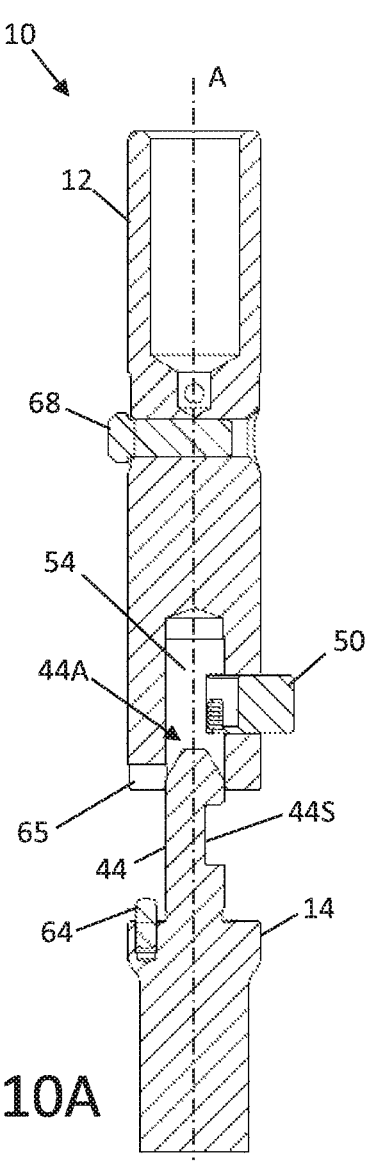
FIGS. 10A and 10B are section views of the punch assembly, with the pivot latch in open (disengaged) and closed (engaged) positions, respectively, utilizing an axial alignment feature.
Figure 10B:
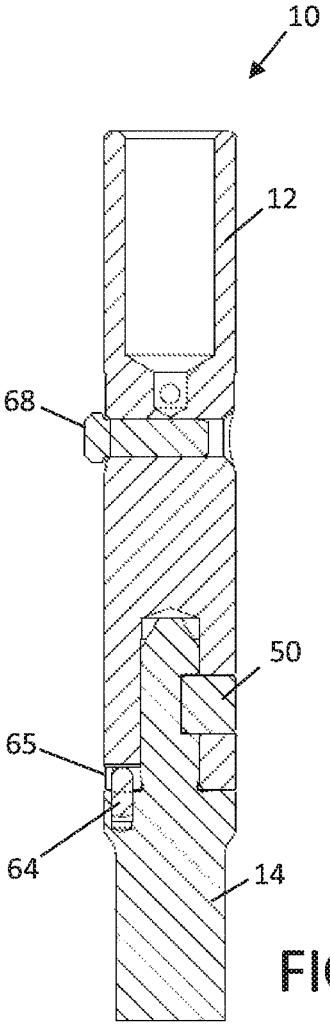

FIG. 10A is a section view of punch assembly 10, in a disengaged position with latch 50 open to show an alternate alignment or precision orientation pin 64 and slot 65. FIG. 10B is an alternate section view of punch assembly 10, in an engaged position with latch 50 closed.

In some embodiments, a single pin can be used for alignment and manipulation of the latch mechanism, as described above. Alternatively, punch tip 14 may have an axially oriented keying-pin 64 positioned at a radial distance from center axis A, and punch body 12 may have a corresponding hole or key-slot 65 to receive keying-pin 64. Precision alignment pin 64 and slot 65 can also be reversed, and provided on punch body 12 and punch tip 14, respectively.

Chamfer features (or a slanted cylindrical surface) on the top end 44A of punch tip stem 44 and/or the inner portion of pivot latch 50 can be configured to cam pivot latch 50 into the open position when stem 44 of punch tip 14 is pushed into axial cavity 54 in punch body 12, while torsion spring 57 resiliently urges pivot latch 50 toward the closed position. Thus, when punch tip 14 is fully installed and engaged onto punch body 12, pivot latch 50 will rotate from the open position by force of torsion spring 57, into the closed position with the inner portion of latch 50 engaged in corresponding slot 44S in the punch insert or punch tip stem 44. Pivot latch 50 can further be constrained, by resilient or various means, as described in the examples below, in order to remain in either the locked or open position, and to ease operation of the latch mechanism.

Once stem 44 of punch tip 14 is completely pushed into axial cavity 54 in punch body 12, pivot latch 50 is rotated by the force of torsional spring 57 from an open or disengaged (unlocked) position into a closed or locked position inside latch pocket 55 in punch body 12. In the closed position, pivot latch 50 engages with the corresponding channel or groove 44S on punch stem (or insert stem) 44.

FIGS. 11A and 11B are section and isometric views, respectively, of punch assembly 10 with punch body 12 suitable for use in a rail-type or single-tool punch press apparatus. Pivot latch 52 is shown in the closed position, with punch tip (or insert) 14 engaged within the axial cavity in punch body 12, and spring ejector 52 compressed against the top of punch tip 14. In these embodiments, punch body 12 can be configured for single-tool or rail-type mounting, utilizing punch key 13 for alignment as described above with respect to FIG. 2.

FIGS. 11C and 11D are section and isometric views, respectively, of a rail-mount punch assembly 10 with punch tip 14 disengaged from punch body 12. Spring latch 50 is shown in the open or unlocked position, with punch tip 14 removed from axial cavity 54 in punch body 12 along punch axis A. In these examples, slot 44S may be formed as a generally circular feature extending about the tang end or stem 44 of punch tip 14, as an alternative to the straight (or "D-shaped") channel embodiments described above.

EXAMPLES

The following examples are provided to illustrate the potential scope of various embodiments. Each of these examples may be provided in any combination with any of the other examples and embodiments described herein.

In any of the embodiments and examples herein, the pivot latch can be resiliently held in place in the open or closed position with a ball plunger, e.g., pressed into the punch body, or by a urethane or other resilient member configured to hold the pivot latch in the alternate open and closed positions.

The interconnection of the punch tip and punch body could also be reversed, such that the punch body has a protruding axial tang and the punch tip has an axial cavity to receive the punch body tang.

Rather than using a key in the side of the punch body and a pin/slot connection with the punch tip to orient and align the punch tip with the punching machine, a punch key could be put into the punch tip, which would thus key directly to the punch guide or bushing.

Rather than a key and key-slot to provide precise angular orientation between the punch tip and punch body, the punch tip shank or stem could be shaped so as to fit in a non-cylindrical pocket in the punch body, to achieve said orientation.

Instead of using a key and key-slot to provide precise angular orientation between the punch tip and punch body, the fit of the pivot latch could be such that it provides precise angular orientation.

A hybrid punch can be provided for a punch press, with a removable lower portion or punch tip held into an upper portion or punch body by a manually operable, spring-loaded pivoting latch which moves rotatably within a cavity in the punch body, selectively engaging and disengaging a receiving feature in the punch tip. The pivoting latch can be manually moved to an open position for installation or removal of the punch tip, or to a closed position where the punch tip and punch body are secured to move slidably together within a punch guide or bushing, and to operate as a punch.

The punch tip has a lower portion or working end for punching or forming sheet material, an upper portion with a protrusion that fits into the lower portion of the punch body, and an engagement feature which can be selectively engaged and disengaged by the pivoting latch. The punch body has an upper portion which connects to a punch canister or similar punch press element, such as by a threaded connection, a lower end with a cavity to receive the punch tip, and a latch feature or cavity to capture the pivoting latch.

The punch tip may have an upper portion including an axial protrusion or stem, opposite the lower or working end, and configured such that the protrusion or stem engages with a pocket in the punch body.

The pivoting latch may be approximately half-cylinder shaped, attached within the punch body to rotate about a pivot near one of its ends, e.g. opposite the free or moving end, and configured to alternately engage and release a receiving slot or cavity in the punch tip.

The pivoting latch can be alternately held resiliently in open or unlocked and closed or locked positions, e.g., with a ball plunger or similar component, preventing unwanted release of the punch tip during handling, while disposed outside of the punch guide or bushing.

The function of the ball plunger could also be achieved with a piece of urethane or other similar part or component, which offers suitable resilient holding properties for the latch in the open and closed positions.

The pivoting latch is not necessarily spring-loaded.

The engagement feature configured for receiving the pivoting latch can be cylindrically formed around the punch tip stem protrusion, or have a full cylindrical symmetry.

The pivoting latch can be sized to prevent disengagement from the punch tip when the punch assembly is installed in a punch guide or bushing, for example having an outer arced or curved surface fitting within the outer diameter of the punch body when locked onto the punch tip, and yet configured so that the arced or curved surface would exceed the outer diameter of said punch body when in an open position, thus assuring the latch securely stays in the locked position when the assembly is installed in a punch guide or bushing.

The pivoting latch can be alternately held in an open or unlocked and closed or locked position with a friction feature, sufficient to prevent unwanted movement or rotation of the latch in a radial direction from the punch body.

The punch body may have a lower shank or stem protrusion and the punch tip may have a corresponding (e.g., axial) cavity configured to receive the shank or stem of the punch body.

The latch is not necessarily attached so as to move rotatably, and may not necessarily be pivoting, but rather may be slidably attached within the punch body assembly, so as to move linearly between the open and closed positions to engage and disengage the punch tip.

The orientation pin and slot can be provided towards the top of the punch tip rather than in the flange portion of the insert.

Figure 12A:
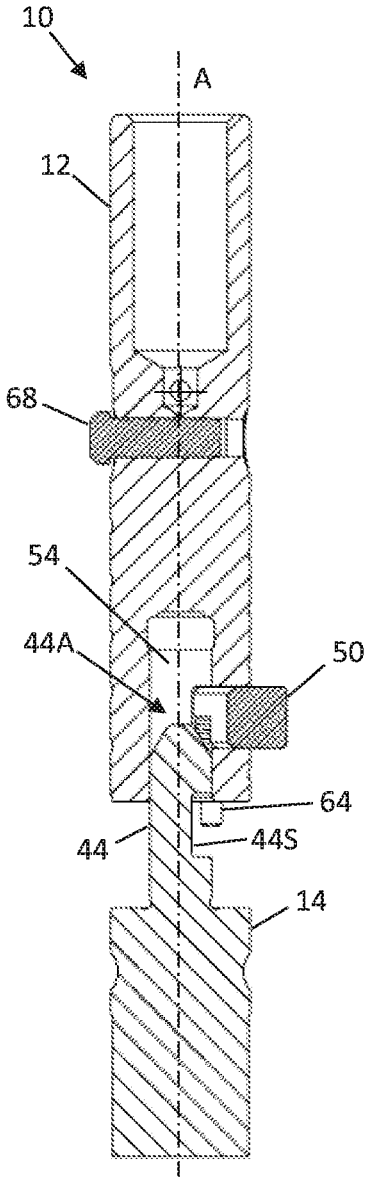
FIGS. 12A and 12B are section views of a punch assembly with the pivot latch in open and closed positions, respectively.
Figure 12B:
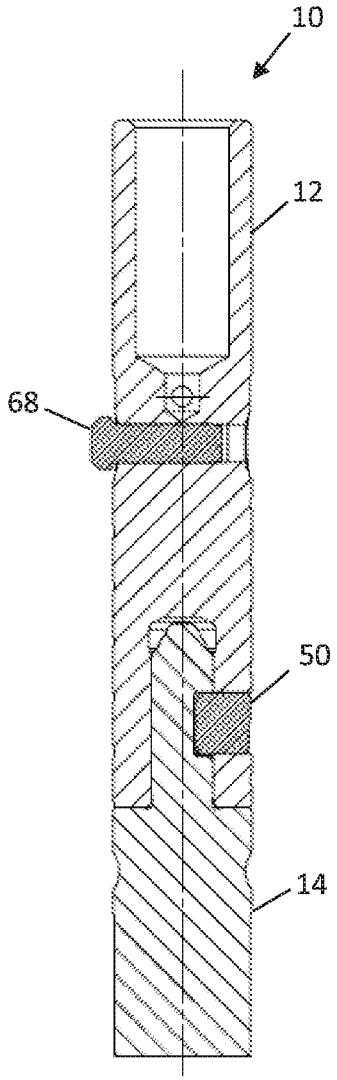

FIG. 12A is a section view of an alternate punch assembly 10, with latch 50 disengaged to show the position of precision orientation pin 64 extending axially from the lower portion of punch body 12. FIG. 12B is an alternate section view of punch assembly 10, with latch 50 engaged. In this position, pin 64 fits into a complimentary slot or hole 65 formed in the top surface of punch tip 14, in order to provide precision angular alignment of punch tip 14 with respect to punch body 12 (see also, e.g., FIGS. 13C and 13D, below).

Figure 13A:
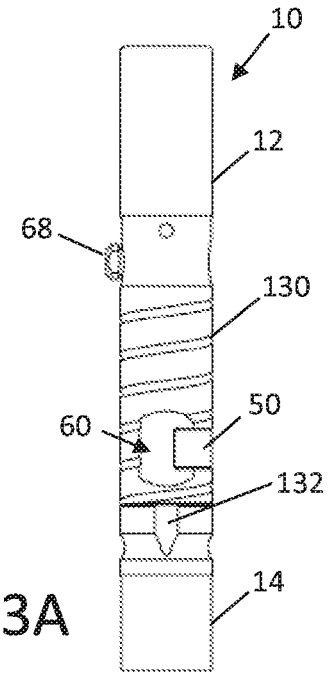
FIGS. 13A and 13B are side and isometric views of a punch assembly with a spiral lubrication groove.
Figure 13B:
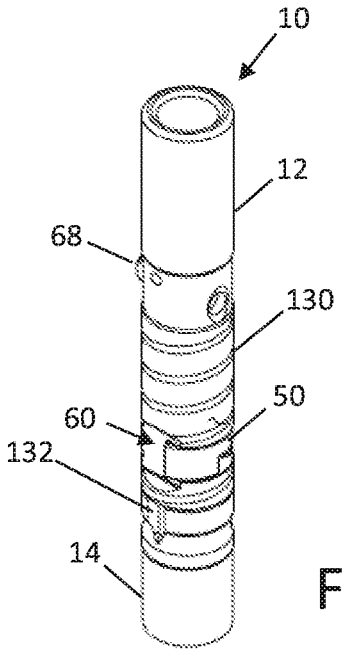
Figure 13C:
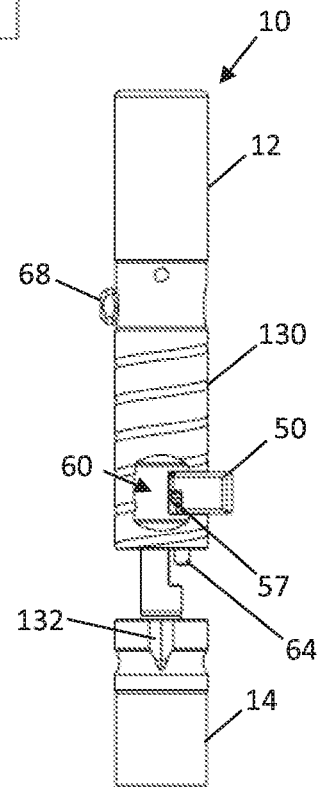
FIGS. 13C and 13D are side and isometric views of the grooved punch assembly, with the punch tip disengaged.
Figure 13D:
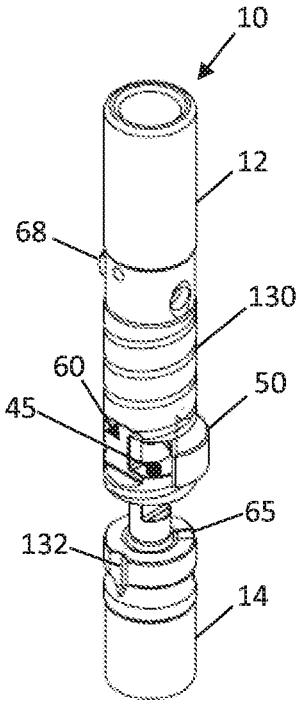

FIGS. 13A and 13B are side and isometric views of a punch assembly 10 with a spiral groove feature 130. In these views, punch tip 14 is engaged within punch body 12, with latch 50 in a closed position. FIGS. 13C and 13D are corresponding views of the grooved punch assembly 10, with latch 50 in an open position and punch tip 14 disengaged. An axial alignment pin 64 extends downward from the bottom surface of punch body 12, and is configured to engage a corresponding slot or hole 65 in punch tip 14.

As shown in FIGS. 13A-13D, spiral lubrication grooves 130 are formed on the outer diameter (OD) of punch body 12, providing more uniform fluid flow for reduced friction punch-to-guide operation. One or more longitudinal or vertical slots 132 can be formed in the outer diameter of punch tip 14, for air/oil flow during punching and stripping operations. Alternatively, a groove 130 may be formed around the punch tip or insert 14, in an optional geometry.

Recess 60 can be provided to access the free end of latch 50, for manual operation between the closed and open positions. A torsion spring 57 or similar component can be provided to pull or pivot latch member 50 back into the closed position, with the outer surface of latch 50 in a conforming or recessed relationship within the OD of punch body 12, as described above. Alternatively, a spring element is not required, and it is possible for the punch guide to hold latch 50 in the closed position when punch tip 14 is inserted, after manually maneuvering latch open 50 and closed. A ball plunger, urethane member, or similar resilient bias element 45 can also be used to hold latch 50 in the open and/or closed position, e.g., in the closed position until punch assembly 10 is inserted into the punch guide.

Figure 14A:
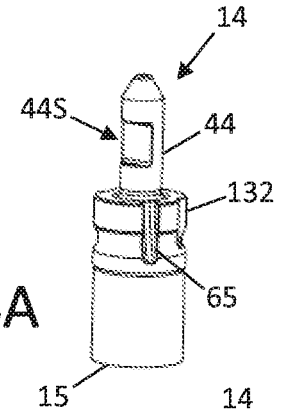
FIGS. 14A and 14B are isometric views of a first representative punch tip or insert.
Figure 14B:
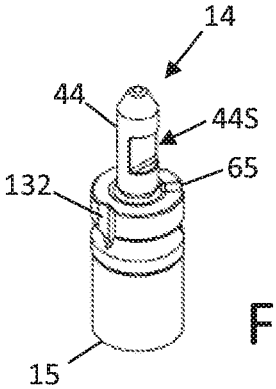
Figure 14C:
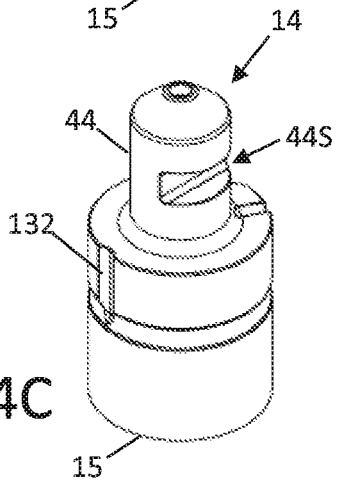
FIGS. 14C and 14D are isometric views of a second representative punch tip or insert.
Figure 14D:
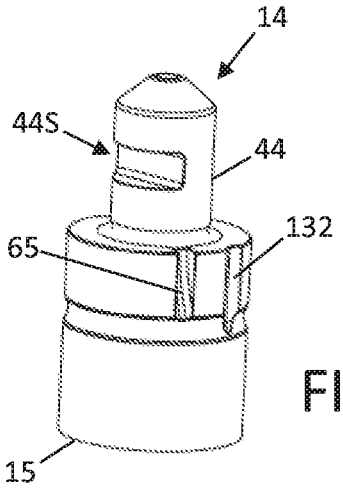
Figure 14E:
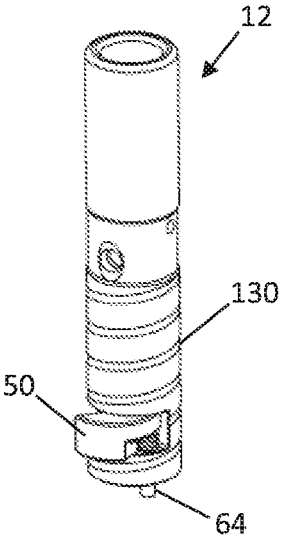
FIGS. 14E and 14F are isometric views of representative punch bodies for use in combination with the punch tips or inserts of FIGS. 14A/14B and FIGS. 14C/14D, respectively.
Figure 14F:
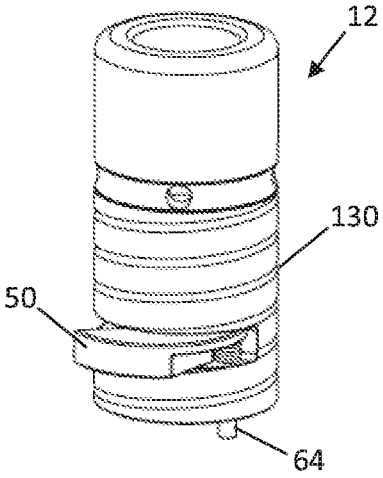

FIGS. 14A and 14B are isometric views of a first representative punch tip 14, as described herein. FIGS. 14C and 14D are isometric views of a second representative punch tip 14. FIG. 14E is an isometric view of a representative punch body 12 for use in combination with punch tip 14 of FIGS. 14A and 14B, and FIG. 14E is a representative punch body 12 for use with punch tip 14 of FIGS. 14C and 14D.

As shown in FIGS. 14A-14F, punch body 12 and punch tip 14 can readily be configured with various different sizes, OD's, and aspect ratios, for example as adapted for different "A" and "B" type stations on a turret press, or in a wide range of other punch tip applications. Similarly, punch point 15 at the working end of punch tip 14 can also take on a variety of forms, such as round, oval, square, rectangular, triangular, oblong, arcuate, polyhedral, etc.

More generally, punch tip (or insert) 14 typically extends from punch point 15 at the first end (or working end) of punch tip 14, to top 44A of stem 44, at the second (opposite) end of punch tip 14. One or more air/oil slots 132 can be provided along the outer diameter of punch tip 14, along with an alignment key slot or hole 65, for example a slanted or curved slot 65 extending to the outer diameter of punch tip 14 as shown. Alternatively, these elements are not required, and one or more of the air/oil slots 132 and alignment slots 65 may be absent, in some embodiments.

A slot or channel 44S is provided in stem 44 to receive the inner portion of latch mechanism 50, when stem 44 is inserted into the punch body. For example, channel 44S may be machined or formed in a middle portion of stem 44, oriented generally transverse to the punch tip axis along g partial arc of stem 44, in order to engage or otherwise accommodate the inner portion of a similarly oriented latch member 50, when in the closed position. For example, top end 44A of the shank or stem 44 can be beveled, tapered or otherwise adapted to open latch 50 upon manual insertion into punch body 12, for example without requiring tools, with latch 50 engaging into slot 44S when stem 44 is fully inserted. Angular alignment can also be provided via suitable tolerance of slot 44S with respect to the inner surface of latch 50, as an alternative to using an alignment pin 64 to operate or facilitate rotation of the latch mechanism, and to engage with a corresponding hole or precision slot 65, as described above.

FIGS. 15A, 15B, 15C, 15D, 15E, 15F, 15G, 15H and 15I are alternate examples of punch assembly 10. Punch assemblies 10 are variously adapted for use in turret press stations or rail-type punch press systems, as described herein.

Referring generally to FIGS. 15A-15I, spiral lubrication grooves 130 may be variously configured on punch body 12 to provide more uniform fluid flow for reduced punch-to-guide friction, e.g., as shown in FIGS. 15A, 15D, 15F and 15I. Air/oil slots 132 may also be provided punch tip 14. In some examples the punch drivers or punch bodies 12 include connecting slots 133 that match up with slots 132 on punch tips 14, e.g., in a longitudinally aligned configuration, as shown in FIGS. 15B, 15D, 15G and 15I. Alternatively, these features are optional, and other air/oil mix flow paths from punch body 12 to punch tip 14 are encompassed.

Figure 16:
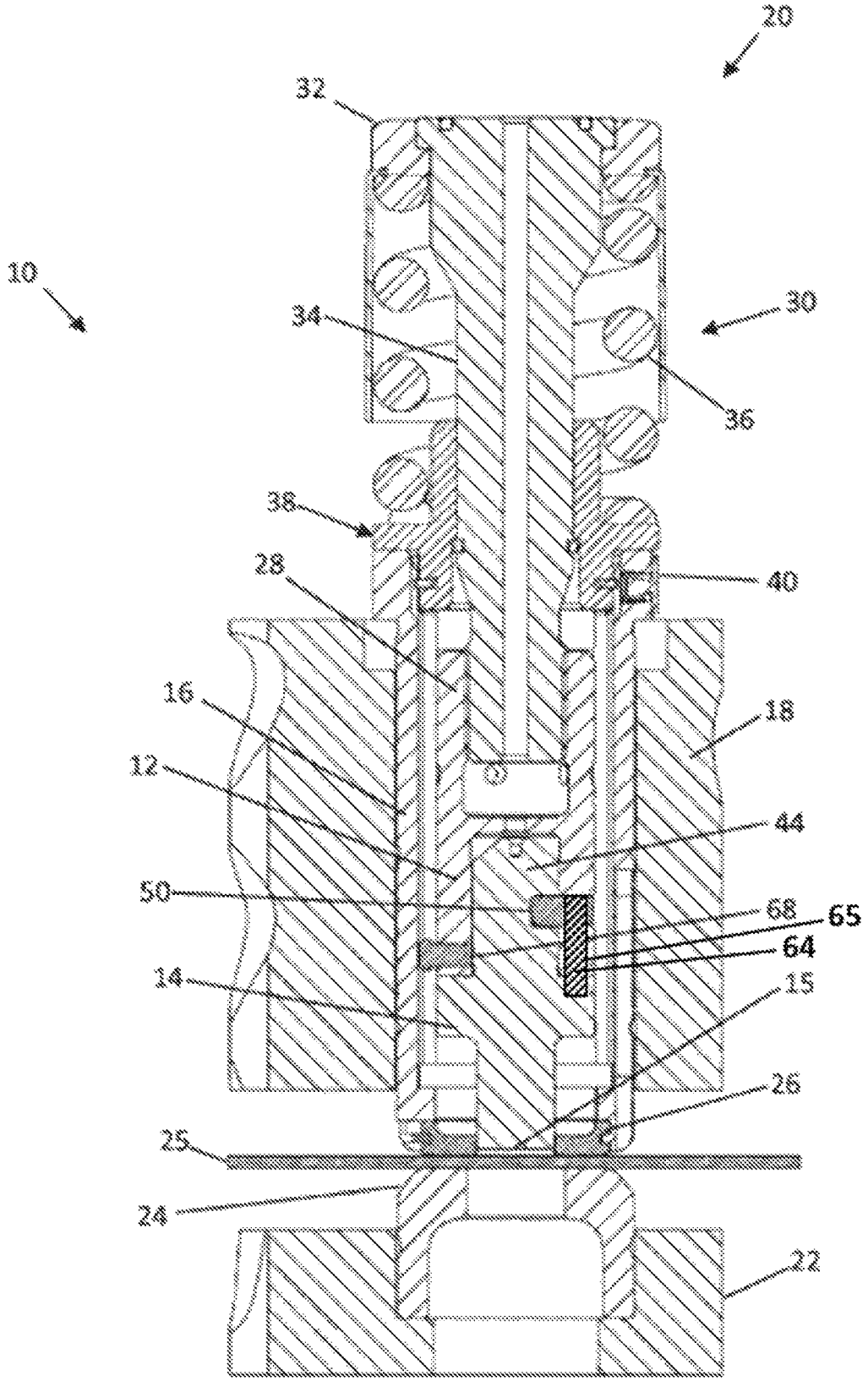
FIG. 16 is a section view of a punch assembly with a replaceable punch tip, as shown in FIG. 1, including an alignment pin and a corresponding hole or slot.

FIG. 16 is a section view of a punch assembly 10 with punch body 12 and a replaceable punch tip 14, as shown in FIG. 1, including an alignment pin 64 and a corresponding hole or slot 65. The alignment pin 64 and slot 65 may provide alignment and angular orientation in the manner described in connection with FIGS. 8A-8C.

More generally, the overall size, length, and aspect ratio of punch assembly 10 varies widely from example to example, along with the relative position and configuration of punch head, latch mechanism 50, punch body alignment key 68, and the other components of the punch assembly and punch press system. The examples are merely representative of the wide range of alternative configurations that are encompassed by the disclosure.

ADDITIONAL EXAMPLES

A punch system comprises: a punch body having a cavity therein; a punch tip comprising a punch tip stem and a working end opposite the punch tip stem along an axis of the punch tip, the punch tip stem being configured for selective engagement and disengagement within the cavity of the punch body; and a latch mechanism comprising a pivoting member configured for the selective engagement of the punch tip stem within the cavity of the punch body in a closed position, and further configured for the selective disengagement of the punch tip from the punch body in an open position.

The punch system may be configured wherein the pivoting member comprises a free end and a hinged end in pivoting engagement with the punch body, the pivoting member configured to pivot about the hinged end for engagement with a receiving slot defined in the punch tip stem with the latch mechanism in the closed position, and for disengagement from the receiving slot with the latch mechanism in the open position.

The punch system may be configured wherein the pivoting member is spring loaded with a spring member and hinge disposed on the hinged end.

The punch system may be configured wherein the free end of the pivoting member is configured to pivot at least partially outward of an outer circumference of the punch body in the open position, and into conforming relation within a pocket defined in the outer circumference of the punch body in the closed position.

The punch system may be configured wherein the free end of the pivoting member is configured to be constrained within the pocket against motion from the closed position to the open position by an inner surface of a punch guide or bushing, when the punch body is disposed therein.

The punch system may be configured wherein the punch tip stem comprises a beveled tip portion configured to actuate the latch mechanism from the closed position to the open position by axial insertion into the cavity of the punch body.

The punch system may be configured wherein the punch tip stem is further configured to engage the latch mechanism in the closed position when the punch tip stem is fully inserted into the cavity.

The punch system may be configured further comprising an ejector member disposed along an axis of the cavity, the ejector member configured to urge the punch tip out of axial engagement with the punch body when the pivot latch mechanism is manipulated from the closed position to the open position.

The punch system may be configured further comprising a resilient outward biasing member configured for engagement between the punch body and punch tip stem when selectively engaged within the cavity.

The punch system may be configured further comprising a precision alignment pin configured to be disposed in the punch body or the punch tip, the precision alignment pin further configured for insertion into a corresponding precision alignment hole or slot defined in the punch tip or punch body, in a longitudinal or transverse configuration for precise angular orientation of the punch tip to the punch body.

The punch system may be configured wherein the alignment pin is adapted to facilitate rotation of the latch mechanism, for example by engagement of the alignment pin with the pivoting member.

The punch system may be configured further comprising complementary precision alignment features integral the punch body and punch tip, the complementary precision alignment features configured for precise angular orientation to be transferred between the punch body and punch tip when engaged along abutting surfaces thereof.

The punch system may be configured wherein the pivoting member is configured for precise angular orientation of the punch tip with respect to the punch body by precision engagement within a receiving feature integral to the punch tip stem.

The punch system may be configured further comprising an alignment member protruding radially from the punch tip, the alignment member configured for engagement with a punch guide or housing to provide precise angular orientation of the punch tip therewith.

The punch system may be configured wherein the latch mechanism is configured to be resiliently held in one or both of the open position and the closed by a ball plunger, and/or urethane member or other resilient element; alternately by a rigid type of fastener.

A punch assembly comprises: a punch body configured for operation in a punch press, the punch body having an axial cavity therein; a punch tip having a working end configured for actuation in the punch press and a stem end opposite the working end, the stem end configured for selective engagement and disengagement within the axial cavity of the punch body; and a latch mechanism coupled to the punch body, the latch mechanism comprising a pivoting member having a hinged end and a free end configured for the selective engagement and disengagement with a slot defined in the stem end of the punch tip.

The punch system or assembly may be configured wherein the hinged end of the pivoting member is spring loaded and the slot defines a generally linear and/or arcuate and/or circumferential channel adapted to receive an inner portion of the free end when the latch mechanism is selectively engaged.

The punch system or assembly may be configured further comprising an alignment slot or hole disposed in the punch tip, the alignment slot or hole configured for angular alignment of the punch tip about an axis of the punch body.

The punch system or assembly may be configured further comprising a pin member disposed in the alignment slot or hole, wherein the pin member is configured to facilitate rotation of the latch mechanism by engagement with the pivoting member.

The punch system or assembly may be configured further comprising generally lateral and adjacent mating surfaces extending circumferentially about the punch tip stem and about the axial cavity on the punch body, the mating surfaces configured to transfer a compressive load from the punch body to the punch tip during the operation of the punch press.

The punch system or assembly may be configured wherein the mating surfaces are configured to substantially isolate the punch tip stem from the compressive load during the operation of the punch press, and wherein the latch mechanism is configured to retain the punch tip within the axial cavity under a tension load during a stripping operation of the punch press.

The punch system or assembly may be configured comprising an elastic member configured for resilient outward biasing engagement between the stem end of the punch tip and the punch body, wherein relative motion between the punch tip and punch body is constrained by the elastic member when the stem end is selectively engaged within the axial cavity.

A punch tip insert is adapted for selective engagement with a punch body, the punch tip insert comprising: a working end configured for actuation by a punch press; a stem disposed opposite the working end along an axis of the punch tip insert, the stem comprising: a slot configured for selective engagement and disengagement with a latch member within an axial cavity in the punch body, the axial cavity disposed along the axis of the punch tip insert; and a beveled tip member configured to actuate the latch member by insertion of the stem into the axial cavity along the punch axis, wherein the slot is configured to engage the latch mechanism when the stem is fully inserted; and a mating surface extending generally circumferentially about the stem of the punch tip insert, the mating surface configured to transfer a compressive load from the punch body to the working end during the actuation by the punch press, wherein the stem is substantially isolated from the compressive load.

The punch tip insert, system or assembly may be configured wherein the slot comprises a substantially linear or arcuate or circumferential channel configured for engagement with an inner surface of the latch member to retain the punch tip insert within the punch body under tension load during a stripping operation of the punch press.

A method comprises engaging the punch tip or insert with the punch body, wherein the stem is inserted into the axial cavity to actuate the latch mechanism from the closed position to the open position and further to engage the latch mechanism in the closed position when the stem is fully inserted.

The punch tip insert, system or assembly may be provided with a recess on the punch body which allows for access to the free end of latch member for manual engagement in the open and closed positions.

While this invention has been described with reference to exemplary embodiments, it will be understood by those skilled in the art that various changes can be made and equivalents may be substituted without departing from the spirit and scope thereof. Modifications may also be made to adapt the teachings of the invention to particular problems, technologies, materials, applications and materials, without departing from the essential scope thereof. Thus, the invention is not limited to the particular examples that are disclosed herein, but encompasses all embodiments falling within the scope of the appended claims.

The invention claimed is:

1. A punch system comprising:

a punch body having a cavity therein;

a punch tip comprising a punch tip stem and a working end opposite the punch tip stem along an axis of the punch tip, the punch tip stem being configured for selective engagement and disengagement within the cavity of the punch body; and a latch mechanism comprising a pivoting latch member on a hinge pin and configured for the selective engagement of the punch tip stem within the cavity of the punch body in a closed position, and further configured for the selective disengagement of the punch tip from the punch body in an open position;

wherein the hinge pin is configured for insertion into a corresponding alignment hole or slot defined in the punch tip for angular orientation of the punch tip to the punch body wherein the pivoting latch member comprises a free end and a hinged end in pivoting engagement with the punch body at the hinge pin, the pivoting latch member being oriented transverse to the axis of the punch tip and configured to pivot about the hinged end for engagement with a receiving slot defined in the punch tip stem with the latch mechanism in the closed position, and for disengagement from the receiving slot with the latch mechanism in the open position.

2. The punch system of claim 1, wherein the latch mechanism is configured to be held in releasable engagement in one or both of the open position and the closed position by a ball plunger or resilient element.

3. The punch system of claim 1, wherein the pivoting latch member is spring loaded with a spring member and the hinge disposed on the hinged end.

4. The punch system of claim 1, wherein the free end of the pivoting latch member is configured to pivot at least partially outward of an outer circumference of the punch body in the open position, and into conforming relation within a pocket defined in the outer circumference of the punch body in the closed position.

5. The punch system of claim 4, wherein the free end of the pivoting latch member is configured to be constrained within the pocket against motion from the closed position to the open position by an inner surface of a punch guide or bushing, when the punch body is disposed therein.

6. The punch system of claim 1, wherein the punch tip stem comprises a beveled tip portion configured to actuate the latch mechanism from the closed position to the open position by manual insertion into the cavity of the punch body.

7. The punch system of claim 6, wherein the punch tip stem is further configured to engage the latch mechanism in the closed position when the punch tip stem is fully inserted into the cavity.

8. The punch system of claim 1, further comprising an ejector member disposed along an axis of the cavity, the ejector member configured to urge the punch tip out of axial engagement with the punch body when the pivot latch mechanism is manipulated from the closed position to the open position.

9. The punch system of claim 1, further comprising a resilient outward biasing member configured for engagement between the punch body and punch tip stem when selectively engaged within the cavity.

10. A method comprising:

engaging a punch tip insert with a punch body, the punch tip insert comprising:

a working end configured for actuation by a punch press;

a stem disposed opposite the working end along an axis of the punch tip insert, the stem comprising a slot configured for selective engagement and disengagement with a latch mechanism comprising a pivoting latch member extending within an axial cavity in the punch body, the axial cavity disposed along the axis of the punch tip insert, and a beveled tip member configured to actuate the pivoting latch member by insertion of the stem into the axial cavity along the punch axis, wherein the slot is configured to engage an inner portion of the pivoting latch member when the stem is fully inserted; and a mating surface extending generally circumferentially about the stem of the punch tip insert, the mating surface configured to transfer a compressive load from the punch body to the working end during the actuation by the punch press, wherein the stem is substantially isolated from the compressive load;

inserting the stem into the axial cavity to actuate the latch mechanism from the closed position to the open position and further to engage the latch mechanism in the closed position when the stem is fully inserted; and disposing a hinge pin in an alignment slot or hole in the punch tip insert, wherein the hinge pin is configured to engage with the pivoting latch member for rotation of the latch mechanism about the hinge pin and the alignment slot or hole is configured for angular alignment of the punch tip insert about an axis of the punch body.

11. The method of claim 10, wherein the slot comprises a linear or arcuate or circumferential channel configured for engagement with an inner surface of the latch member oriented transverse to the axis of the punch tip to retain the punch tip insert within the punch body under tension load during a stripping operation of the punch press.

12. The method of claim 10, further comprising orienting the punch tip insert using the hinge pin protruding into the slot or hole in an upper flange portion of the punch tip insert.

13. A punch system comprising:

a punch body having a cavity therein;

a punch tip comprising a punch tip stem and a working end opposite the punch tip stem along an axis of the punch tip, the punch tip stem being configured for selective engagement and disengagement within the cavity of the punch body; and a latch mechanism comprising a pivoting latch member on a hinge pin and configured for the selective engagement of the punch tip stem within the cavity of the punch body in a closed position, and further configured for the selective disengagement of the punch tip from the punch body in an open position;

wherein the hinge pin is configured for insertion into a corresponding alignment hole or slot defined in the punch tip for angular orientation of the punch tip to the punch body;

wherein the hinge pin is adapted to engage with the pivoting latch member for rotation of the latch mechanism such that the pivoting latch member pivots about the hinge pin and the punch system is adapted for angular orientation of the punch tip to the punch body wherein the pivoting latch member has a free end for engagement within a receiving slot integral to the punch tip stem.

14. The punch system of claim 13, wherein the receiving slot comprises a linear, arcuate, half-cylinder or D-shaped slot form in the punch tip stem and adapted to accept a similarly-shaped portion of the pivoting latch member to secure the punch tip to the punch body and to provide the angular orientation of the punch tip with respect thereto.

15. A punch assembly comprising:

a punch body configured for operation in a punch press, the punch body having an axial cavity therein;

a punch tip having a working end configured for actuation in the punch press and a stem end opposite the working end, the stem end configured for selective engagement and disengagement within the axial cavity of the punch body;

a latch mechanism coupled to the punch body, the latch mechanism comprising a pivoting latch member having a hinged end on a hinge pin and a free end configured for the selective engagement and disengagement with a slot defined in the stem end of the punch tip; and an alignment slot or hole disposed in the punch tip, the alignment slot or hole configured for angular alignment of the punch tip about an axis of the punch body;

wherein the hinge pin is configured to engage with the pivoting latch member for rotation of the latch mechanism about the hinged end, on the hinge pin.

16. The punch assembly of claim 15, further comprising an elastic member configured for resilient outward biasing engagement between the stem end of the punch tip and the punch body, wherein relative motion between the punch tip and punch body is constrained by the elastic member when the stem end is selectively engaged within the axial cavity.

17. The punch assembly of claim 15, wherein the hinged end of the pivoting latch member is spring loaded and the slot defines a generally linear or arcuate or circumferential channel in the stem end of the punch tip, adapted to receive an inner portion of the free end of the pivoting latch member oriented transverse to the axis of the punch tip, when the latch mechanism is selectively engaged.

18. The punch assembly of claim 15, wherein the hinge pin is configured for rotation of the latch mechanism by engagement with the pivoting latch member.

19. The punch assembly of claim 15, further comprising generally lateral and adjacent mating surfaces extending circumferentially about the punch tip stem and about the axial cavity on the punch body, the mating surfaces configured to transfer a compressive load from the punch body to the punch tip during the operation of the punch press.

20. The punch assembly of claim 19, wherein the mating surfaces are configured to substantially isolate the punch tip stem from the compressive load during the operation of the punch press, and wherein the latch mechanism is configured to retain the punch tip within the axial cavity under a tension load during a stripping operation of the punch press.

* * * * *